US011248604B2

(12) United States Patent
Iwatake et al.

(10) Patent No.: US 11,248,604 B2
(45) Date of Patent: Feb. 15, 2022

(54) SCROLL COMPRESSOR AND REFRIGERATION CYCLE APPARATUS

(71) Applicant: Mitsubishi Electric Corporation, Chiyoda-ku (JP)

(72) Inventors: Wataru Iwatake, Chiyoda-ku (JP); Shin Sekiya, Chiyoda-ku (JP); Raito Kawamura, Chiyoda-ku (JP); Kei Sasaki, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 164 days.

(21) Appl. No.: 16/500,699

(22) PCT Filed: Jun. 6, 2017

(86) PCT No.: PCT/JP2017/020985
§ 371 (c)(1),
(2) Date: Oct. 3, 2019

(87) PCT Pub. No.: WO2018/225155
PCT Pub. Date: Dec. 13, 2018

(65) Prior Publication Data
US 2020/0191145 A1 Jun. 18, 2020

(51) Int. Cl.
*F04C 18/02* (2006.01)
*F04C 29/02* (2006.01)
(Continued)

(52) U.S. Cl.
CPC ..... *F04C 18/0215* (2013.01); *F04C 29/026* (2013.01); *F04C 2210/14* (2013.01); *F04C 2210/206* (2013.01); *F04C 2240/30* (2013.01)

(58) Field of Classification Search
CPC ..... F04C 23/008; F04C 28/26; F04C 29/065; F04C 29/068; F04C 29/026; F04C 29/021;
(Continued)

(56) References Cited

U.S. PATENT DOCUMENTS 7,736,137 B2 6/2010 Ueno et al.
7,862,313 B2 * 1/2011 Hwang ..... F04C 18/0215 418/55.6
(Continued)

FOREIGN PATENT DOCUMENTS

CN 101268280 A 9/2008
JP 62091686 A * 4/1987 ..... F04C 29/02
(Continued)

OTHER PUBLICATIONS

English translation of JP 62091686 by Espacenet, May 20, 2021.*
(Continued)

*Primary Examiner* — Deming Wan
(74) *Attorney, Agent, or Firm* — Xsensus LLP

(57) ABSTRACT

In a scroll compressor, a first flow passage is formed in a fixed base plate and a frame to supply oil separated by an oil separating mechanism provided in a sealed container to an oil sump at the bottom of the sealed container. In the fixed base plate, a second flow passage is formed to supply the oil separated by the oil separating mechanism into a compression mechanism.

12 Claims, 17 Drawing Sheets

(51) Int. Cl.

| | |
|---|---|
| ***F04C 28/02*** | (2006.01) |
| ***F04C 29/06*** | (2006.01) |
| ***F04C 14/26*** | (2006.01) |
| ***F04C 28/26*** | (2006.01) |
| ***F04C 23/00*** | (2006.01) |

(58) Field of Classification Search
CPC .. F04C 29/02; F04C 18/0215; F04C 15/0088; F04C 15/0092
See application file for complete search history.

(56) References Cited

U.S. PATENT DOCUMENTS

| | | | | |
|---|---|---|---|---|
| 2005/0135940 | A1* | 6/2005 | Jeong | F04C 23/008 417/310 |
| 2007/0140872 | A1* | 6/2007 | Hutt | F04C 28/26 417/310 |
| 2007/0140884 | A1* | 6/2007 | Kim | F04C 29/065 418/55.6 |
| 2009/0169406 | A1 | 7/2009 | Ueno et al. | |
| 2009/0260372 | A1* | 10/2009 | Skinner | B01D 53/0462 62/93 |
| 2018/0128270 | A1 | 5/2018 | Koyama et al. | |

FOREIGN PATENT DOCUMENTS

| | | | |
|---|---|---|---|
| JP | 02-146285 | A | 6/1990 |
| JP | 2005-180295 | A | 7/2005 |
| JP | 2014-152683 | A | 8/2014 |
| WO | WO 2016/199281 | A1 | 12/2016 |

OTHER PUBLICATIONS

Extended European Search Report dated May 15, 2020, issued in corresponding European Patent Application No. 17912754.3, 6 pages.
International Search Report dated Aug. 15, 2017 in PCT/JP2017/020985 filed on Jun. 6, 2017.
Office Action dated Oct. 23, 2020 issued in corresponding CN patent application No. 201780089930.0.
Office Action dated Jun. 8, 2021, in corresponding Chinese patent Application No. 201780089930.0, 15 pages.

* cited by examiner

SCROLL COMPRESSOR AND REFRIGERATION CYCLE APPARATUS

TECHNICAL FIELD

The present invention relates to a low-pressure shell scroll compressor and a refrigeration cycle apparatus.

BACKGROUND ART

In the past, there has been provided a scroll compressor that includes, in a sealed container provided with an oil sump formed at the bottom of the sealed container, a compression mechanism that compresses refrigerant and an oil separating mechanism (see, for example, Patent Literature 1). Patent Literature 1 discloses a technique in which a refrigerating machine oil is separated by the oil separating mechanism from the refrigerant compressed by the compression mechanism and discharged into discharge space in the container, and the refrigerating machine oil is stored in the oil sump in a lower portion of the compressor. The refrigerating machine oil in the oil sump is pumped up through a pumping action by rotation of a rotation shaft that drives the compression mechanism. The refrigerating machine oil is then supplied to a sliding portion of the compression mechanism to lubricate the sliding portion of the compression mechanism and also to seal gaps in the sliding portion.

CITATION LIST

Patent Literature

Patent Literature 1: Japanese Unexamined Patent Application Publication No. 2014-152683

SUMMARY OF INVENTION

Technical Problem

In the technique disclosed in Patent Literature 1, the entire refrigerating machine oil separated from the refrigerant is returned to the oil sump in the lower portion of the compressor. Therefore, in the case of supplying the refrigerating machine oil from the oil sump to the sliding portion of the compression mechanism, a low-speed operation in which the rotation speed of the rotation shaft is low has the following problem. That is, during the low-speed operation, the pumping action is reduced, oil supply becomes insufficient and the sealing performance in the compression mechanism is reduced. The refrigerant being in a low-pressure state is sucked into the compression mechanism, compressed in the compression mechanism, and discharged into the discharge space. Therefore, in the case where the sealing performance in the compression mechanism is reduced, refrigerant leaks from the high-pressure side to the low-pressure side in the compression mechanism, thereby deteriorating the performance of the compressor.

The present invention has been made to solve the above problem, and an object of the present invention is to provide a scroll compressor and a refrigeration cycle apparatus that can reduce the degradation of the performance thereof which is caused by leakage of refrigerant from a high-pressure side to a low-pressure side in a compression mechanism.

Solution to Problem

A scroll compressor according to an embodiment of the present invention includes: a compression mechanism including a fixed scroll and an orbiting scroll, the fixed scroll including a fixed base plate having a discharge port and a fixed spiral element, the orbiting scroll including an orbiting base plate and an orbiting spiral element, the fixed spiral element and the orbiting spiral element being combined in an axial direction of the compression mechanism to define a suction chamber and a compression chamber, the compression mechanism being configured to suck a gaseous fluid containing oil from the suction chamber into the compression chamber, compress the sucked fluid, and discharge the compressed fluid from the discharge port; a sealed container housing the compression mechanism, having a discharge space and a suction space both provided in the compression mechanism, and including an oil sump to store oil therein at a bottom of the suction space, the discharge space being located on a side of the fixed base plate that is opposite to the compression chamber, the suction space being provided to allow a fluid to be sucked from an outside into the suction space; a frame configured to support the orbiting scroll on a side of the orbiting scroll that is opposite to the compression chamber; and an oil separating mechanism provided in the discharge space to cover the discharge port, including a guide container having a blowoff port, and configured to swirl a fluid blown into an oil separation space through the discharge port and the blowoff port to separate oil from the fluid, the oil separation space being provided in the discharge space and outward of the guide container. The fixed base plate and the frame have a first flow passage that extends through the fixed base plate and the frame to supply the oil separated by the oil separating mechanism to the oil sump. The fixed base plate has a second flow passage which extends through the fixed base plate to supply the oil separated by the oil separating mechanism into the compression mechanism.

A refrigeration cycle apparatus according to another embodiment of the present invention includes the scroll compressor described above, a condenser, a pressure-reducing device, and an evaporator.

Advantageous Effects of Invention

In the embodiments of the present invention, since part of refrigerating machine oil separated in the sealed container is supplied into the compression mechanism, it is possible to reduce degradation of the sealing performance of the compression mechanism.

DESCRIPTION OF EMBODIMENTS

Figure 1:
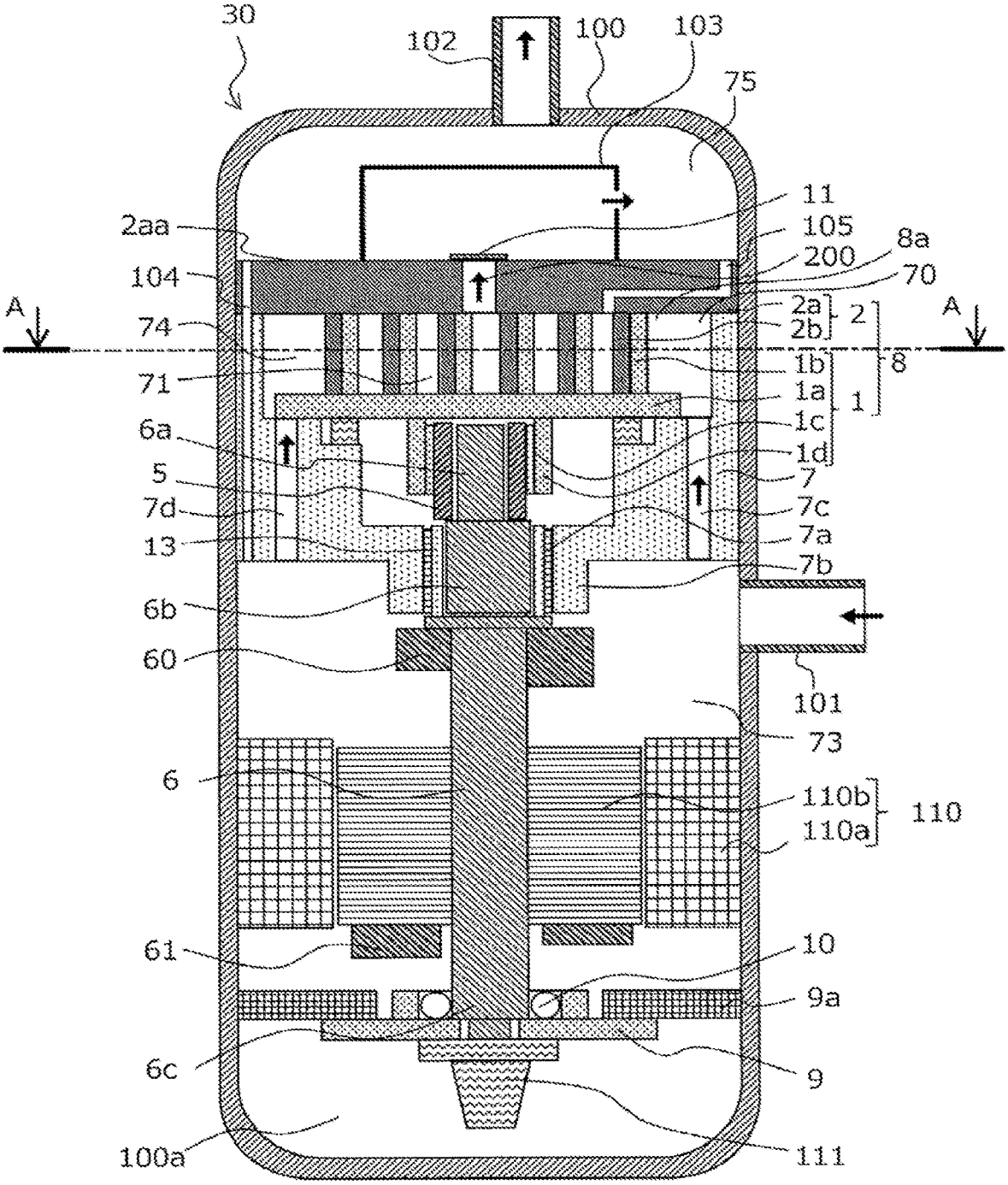
FIG. 1 is a schematic vertical cross-sectional view illustrating the entire configuration of a scroll compressor according to Embodiment 1 of the present invention.

Scroll compressors according to the embodiments of the present invention will be described with reference to the drawings. In each of the figures in the drawings, which include FIG. 1, components which are the same as or equivalent to those in a previous figure are denoted by the same reference numerals. The same is true of the following entire text of the specification relating to the embodiments. It should be noted that the configurations of components as described throughout the entire text description are merely examples, that is, the configurations of the components are not limited to those described in the specification.

Embodiment 1

Figure 2:
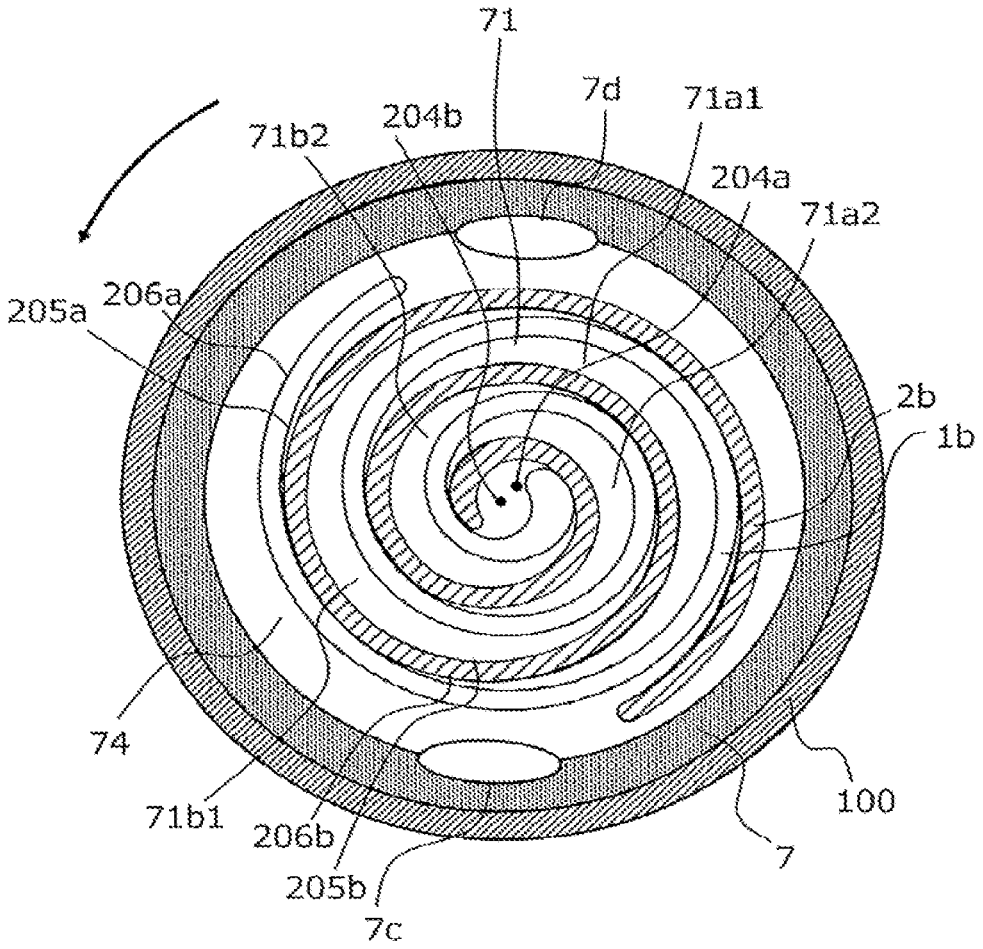
FIG. 2 is a schematic horizontal cross-sectional view illustrating a compression mechanism and the vicinity thereof in the scroll compressor according to Embodiment 1 of the present invention.

FIG. 1 is a schematic vertical cross-sectional view illustrating the entire configuration of a scroll compressor according to Embodiment 1 of the present invention. In FIG. 1, arrows each indicate the flow direction of refrigerant. The same is true of other schematic vertical cross-sectional views which will be referred to below. FIG. 2 is a schematic horizontal cross-sectional view illustrating a compression mechanism and the vicinity thereof in the scroll compressor according to Embodiment 1 of the present invention.

A scroll compressor 30 according to Embodiment 1 includes a compression mechanism 8, a motor mechanism 110 that drives the compression mechanism 8 using a rotation shaft 6, and other components. The scroll compressor 30 houses these components in a sealed container 100 forming an outer periphery of the scroll compressor 30. In the sealed container 100, the rotation shaft 6 transmits torque from the motor mechanism 110 to an orbiting scroll 1. The orbiting scroll 1 is eccentrically coupled to the rotation shaft 6 and performs an orbital motion by the torque from the motor mechanism 110. The scroll compressor 30 is a so-called low-pressure shell scroll compressor that temporarily introduces a low-pressure gaseous fluid into the internal space of the sealed container 100 and compresses the gaseous fluid. As the gaseous fluid that is compressed by the scroll compressor 30, for example, refrigerant or air that changes in phase can be used. In the following description, it is assumed that the fluid is refrigerant.

In the sealed container 100, a frame 7 and a sub-frame 9 are arranged opposite to each other in the axial direction of the rotation shaft 6, with the motor mechanism 110 interposed between the frame 7 and the sub-frame 9. The frame 7 is located above the motor mechanism 110 and between the motor mechanism 110 and the compression mechanism 8. The sub-frame 9 is located below the motor mechanism 110. The frame 7 is secured, for example, by shrink fitting or welding to the inner periphery of the sealed container 100. The sub-frame 9 is secured, for example, by shrink fitting or welding to the inner periphery of the sealed container 100, with a sub-frame holder 9*a* interposed between the sub-frame 9 and the inner periphery of the sealed container 100.

A pump element 111 including a positive-displacement pump is attached to the lower side of the sub-frame 9 in such a manner that the rotation shaft 6 is supported by an upper end face of the pump element 111 in the axial direction of the rotation shaft 6. The pump element 111 is configured to supply refrigerating machine oil stored in an oil sump 100*a* at a bottom portion of the sealed container 100, to a sliding portion of the compression mechanism 8, such as a main bearing 7*a*, which will be described below.

The sealed container 100 is provided with a suction pipe 101 for use in suction of the refrigerant and a discharge pipe 102 for use in discharge of the refrigerant. The refrigerant is introduced into the internal space of the sealed container 100 through the suction pipe 101.

In Embodiment 1, spaces provided in the sealed container 100 will be referred to as follows. A housing space in the sealed container 100 and closer to the motor mechanism 110 than the frame 7 will be referred to as a suction space 73. The suction space 73 is a low-pressure space that is filled with refrigerant having a suction pressure and sucked through the suction pipe 101. A space interposed between the frame 7 and a fixed base plate 2*a* to be described later will be referred to as a spiral space 74. Space closer to the discharge pipe 102 than the fixed base plate 2*a* of the compression mechanism 8 will be referred to as a discharge space 75. The discharge space 75 is a high-pressure space filled with refrigerant compressed by the compression mechanism 8. The sealed container 100 is a so-called low-pressure shell container in which refrigerant is temporarily introduced into the suction space 73 before compressed.

The compression mechanism 8 has a function of compressing the refrigerant sucked through the suction pipe 101, and discharging the compressed refrigerant to the discharge space 75 in an upper region in the sealed container 100. The discharge space 75 is a high-pressure space since the compressed refrigerant flows into the discharge space 75.

The compression mechanism 8 includes the orbiting scroll 1 and a fixed scroll 2.

The fixed scroll 2 is secured to the sealed container 100, with the frame 7 interposed between the fixed scroll 2 and the sealed container 100. The orbiting scroll 1 is located on a lower side of the fixed scroll 2 and supported by an eccentric shaft portion 6*a* (described below) of the rotation shaft 6 such that the orbiting scroll 1 can make an orbit motion.

The orbiting scroll 1 includes an orbiting base plate 1*a* and an orbiting spiral element 1*b* that is a scroll projection provided upright on one of surfaces of the orbiting base plate 1*a*. The fixed scroll 2 includes the fixed base plate 2*a* and a fixed spiral element 2*b* that is a scroll projection provided upright on one of surfaces of the fixed base plate 2*a*. The orbiting spiral element 1*b* and the fixed spiral element 2*b* are formed along an involute curve. The orbiting scroll 1 and the fixed scroll 2 are disposed in the sealed container 100, with the orbiting spiral element 1*b* and the fixed spiral element 2*b* combined in opposite phase and spirally symmetric with respect to the rotation center of the rotation shaft 6. In the compression mechanism 8 including the orbiting scroll 1 and the fixed scroll 2, a spirally symmetric structure formed by combining the orbiting spiral element 1*b* and the fixed spiral element 2*b* will hereinafter be referred to as a spiral structure 8*a*.

Figure 3:
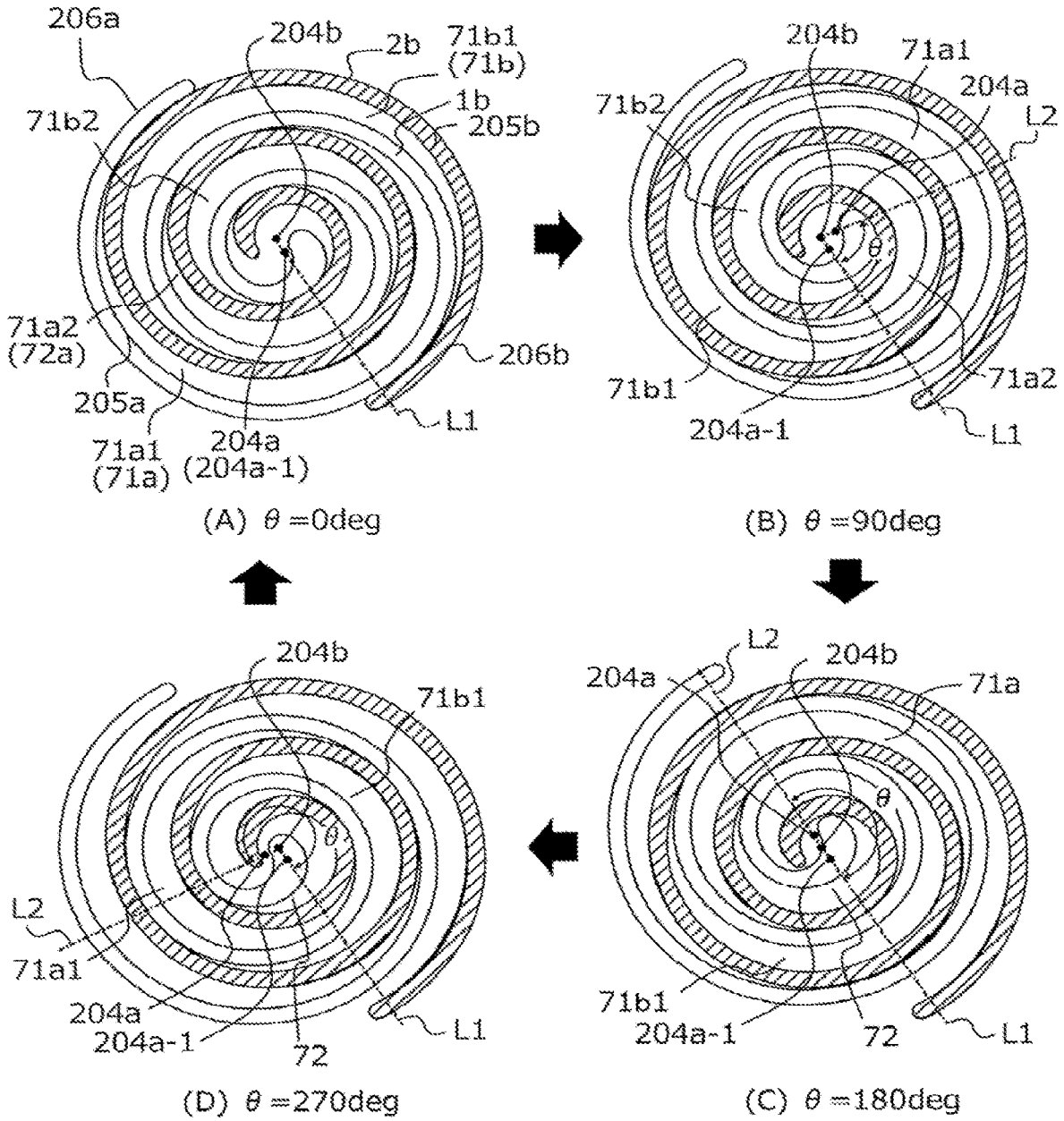
FIG. 3 is a compression process chart illustrating how an orbiting scroll moves during one rotation in a cross-section taken along line A-A in FIG. 1, in the scroll compressor according to Embodiment 1 of the present invention.

As illustrated in FIG. 2, the center of a base circle of an involute curve in which the orbiting spiral element 1*b* moves will be referred to as a base circle center 204*a*. Also, the center of a base circle of an involute curve in which the fixed spiral element 2*b* moves will be referred to as a base circle center 204*b*. When the base circle center 204*a* is rotated around the base circle center 204*b*, the orbiting spiral element 1*b* performs an orbital motion around the fixed spiral element 2*b*, as illustrated in FIG. 3 (described below). The motion of the orbiting scroll 1 during the operation of the scroll compressor 30 will be described in detail later on.

As viewed along spirals from the center of the spirals to a winding end of the spirals in an involute direction of the spirals, an inward surface 205*a* of the orbiting spiral element 1*b* contacts an outward surface 206*b* of the fixed spiral element 2*b* at a plurality of contact points. That is, space between the inward surface 205*a* of the orbiting spiral element 1*b* and the outward surface 206*b* of the fixed spiral element 2*b* is divided at the plurality of contact points into a compression chamber 71*a*1, a compression chamber 71*a*2, and other compression chambers. Hereinafter, the compression chamber 71*a*1, the compression chamber 71*a*2, and other compression chambers will be collectively referred to as a compression chamber 71*a*.

Also, as viewed along the spirals from the center to the winding end in the involute direction of the spirals, an inward surface 205*b* of the fixed spiral element 2*b* contacts an outward surface 206*a* of the orbiting spiral element 1*b* at a plurality of contact points. That is, space between the inward surface 205*b* of the fixed spiral element 2*b* and the outward surface 206*a* of the orbiting spiral element 1*b* is divided at the plurality of contact points into a compression chamber 71*b*1, a compression chamber 71*b*2, and other compression chambers. Hereinafter, the compression chamber 71*b*1, the compression chamber 71*b*2, and other compression chambers will be collectively referred to as a compression chamber 71*b*. Also, the compression chamber 71*a* and the compression chamber 71*b* will be collectively referred to as a compression chamber 71.

Thus, the orbiting spiral element 1*b* provided on the orbiting base plate 1*a* of the orbiting scroll 1 and the fixed spiral element 2*b* provided on the fixed base plate 2*a* of the fixed scroll 2 are combined to define the compression chamber 71.

The spiral structure 8*a* formed by combining the orbiting spiral element 1*b* and the fixed spiral element 2*b* has a spirally symmetric shape. Thus, as illustrated in FIG. 2, the spiral structure 8*a* includes a plurality of pairs of compression chamber 71*a* and compression chamber 71*b*, which are symmetric with respect to the rotation center of the rotation shaft 6, and are arranged from an outer side of spirals to an inner side of the spirals. FIG. 2 illustrates two pairs by way of example.

A central part of the spiral structure 8*a* is an innermost chamber corresponding to space surrounded by the inward surface 205*a* of the orbiting spiral element 1*b*, the inward surface 205*b* of the fixed spiral element 2*b*, the orbiting base plate 1*a*, and the fixed base plate 2*a*. The fixed base plate 2*a* has a discharge port 200 (see FIG. 1) that allows the compressed refrigerant to be discharged. The discharge port 200 is formed in part of the fixed base plate 2*a* that forms part of the innermost chamber.

The spiral structure 8*a* is provided with a refrigerant inlet 7*c* and a refrigerant inlet 7*d* at an outer periphery of the spiral structure 8*a*. The refrigerant inlet 7*c* and the refrigerant inlet 7*d* are formed in the frame 7 to guide the refrigerant sucked through the suction pipe 101 to the compression mechanism 8.

Referring FIG. 1, the refrigerant sucked through the suction pipe 101 into the sealed container 100 is introduced through the refrigerant inlet 7*c* and the refrigerant inlet 7*d* into a suction chamber 70 in the compression mechanism 8. In the spiral space 74, the suction chamber 70 is a tubular space between the spiral structure 8*a* and the sealed container 100 and communicates with the suction space 73 through the refrigerant inlet 7*c* and the refrigerant inlet 7*d*. As the orbiting spiral element 1*b* swirls, the positions where the fixed spiral element 2*b* is in contact with the orbiting spiral element 1*b* move, and the volume of the compression chamber 71 varies, whereby the refrigerant in the compression chamber 71 is compressed. The compressed refrigerant is discharged from the discharge port 200.

The compression chamber 71 is sealed in the following manner. A sealing member not illustrated is inserted in an edge of the orbiting spiral element 1*b*, which is an end portion of the orbiting spiral element 1*b* in the axial direction. During operation, the sealing member contacts part of the fixed base plate 2*a* that the sealing member faces, and slides. As a result, the space between the edge and the above part of the fixed base plate 2*a* is sealed. Similarly, another sealing member not illustrated is inserted in an edge of the fixed spiral element 2*b*, which is an end portion of the fixed spiral element 2*b* in the axial direction. During operation, the sealing member contacts part of the orbiting base plate 1*a* that the sealing member faces, and slides. As a result, the space between the edge and the above part of the orbiting base plate 1*a* is sealed. The orbiting spiral element 1*b* and the fixed spiral element 2*b* are formed such that they each have an appropriate thickness in terms of strength in a direction orthogonal to the axial direction, and that their edge portions are flat.

In the orbiting base plate 1*a* of the orbiting scroll 1, a hollow cylindrical boss 1*d* is formed at substantially the center of a surface of the orbiting base plate 1*a* that is opposite to a surface thereof that has the orbiting spiral element 1*b* formed thereon. The eccentric shaft portion 6*a* (described below) formed at the upper end of the rotation shaft 6 is coupled to the inner periphery of the boss 1*d*, with a slider 5 (described below) interposed between the eccentric shaft portion 6*a* and the inner periphery of the boas 1*d*.

In the fixed base plate 2*a* of the fixed scroll 2, the discharge port 200 is formed therethrough to discharge compressed refrigerant gas, and a discharge valve 11 is provided at an outlet portion of the discharge port 200. Furthermore, in the fixed base plate 2*a*, a first flow passage 104 and a second flow passage 105 are formed, the first flow passage 104 being formed together with a hole extending through the frame 7. The first flow passage 104 and the second flow passage 105 will be described in detail later on.

The refrigerant sucked into the scroll compressor 30 contains refrigerating machine oil that lubricates the sliding portion of the compression mechanism 8. In the discharge space 75 in the sealed container 100, an oil separating mechanism 103 is provided to separate the refrigerating machine oil from the refrigerant having passed through the sliding portion. The oil separating mechanism 103 is provided on a back surface 2*aa* of the fixed base plate 2*a* that is opposite to the compression chamber 71, in such a manner as to cover the discharge port 200. The oil separating mechanism 103 will be described in detail later on.

The frame 7 has a thrust surface to which the fixed scroll 2 is secured. The thrust surface of the frame 7 supports, in the axial direction, a thrust load acting on the orbiting scroll 1. The frame 7 has the refrigerant inlet 7*c* and the refrigerant inlet 7*d* that extend through the frame 7. Via the refrigerant inlet 7*c* and the refrigerant inlet 7*d*, the suction space 73 and the spiral space 74 communicate with each other. Also, the refrigerant inlet 7*c* and the refrigerant inlet 7*d* guide the refrigerant sucked through the suction pipe 101 to the compression mechanism 8.

The motor mechanism 110 that gives a rotational driving force to the rotation shaft 6 includes a motor stator 110*a* and a motor rotator 110*b*. To receive power from the outside, the motor stator 110*a* is connected by a lead wire (not illustrated) to a glass terminal (not illustrated) provided between the frame 7 and the motor stator 110*a*. The motor rotator 110*b* is secured to the rotation shaft 6, for example, by shrink fitting. In order to balance the entire rotational system of the scroll compressor 30, a first balance weight 60 is secured to the rotation shaft 6, and a second balance weight 61 is secured to the motor rotator 110*b*.

The rotation shaft 6 includes the eccentric shaft portion 6*a* located at an upper portion of the rotation shaft 6, a main shaft portion 6*b*, and a sub-shaft portion 6*c* located at a lower portion of the rotation shaft 6. The boss 1*d* of the orbiting scroll 1 is fitted over the eccentric shaft portion 6*a*, with the slider 5 and the orbiting bearing 1*c* interposed between the boss 1*d* and the eccentric shaft portion 6*a*. The eccentric shaft portion 6*a* is slid over the orbiting bearing 1*c*, with a layer of refrigerating machine oil interposed between the eccentric shaft portion 6*a* and the orbiting bearing 1*c*. The orbiting bearing 1*c* is secured to an inner side of the boss 1*d* by press-fitting a bearing material, for example, a copper-lead alloy, which is used for a slide bearing, into the boss 1*d*. The main shaft portion 6*b* is fitted into the main bearing 7*a* on the inner periphery of a boss 7*b* of the frame 7, with a sleeve 13 interposed between the main shaft portion 6*b* and the main bearing 7*a*. The main shaft portion 6*b* is slid over the main bearing 7*a*, with a layer of refrigerating machine oil between the main shaft portion 6*b* and the main bearing 7*a*. The main bearing 7*a* is secured to an inner side of the boss 7*b* by press-fitting into the boss 7*b*, a bearing material, for example, a copper-lead alloy, which is used for a slide bearing.

The sub-frame 9 includes, in the central portion thereof, a sub-bearing 10 which is a ball bearing. The sub-bearing 10 is provided below the motor mechanism 110 and rotatably supports the rotation shaft 6 in the radial direction. The sub-bearing 10 may be formed to have a bearing structure other than that of the ball bearing in order to rotatably support the rotation shaft 6. The sub-shaft portion 6*c* is fitted into the sub-bearing 10 and slide over the sub-bearing 10. The axial center of the main shaft portion 6*b* and the sub-shaft portion 6*c* coincides with the axial center of the rotation shaft 6.

FIG. 3 is a compression process chart illustrating how the orbiting scroll moves during one rotation thereof in a cross section taken along line A-A in FIG. 1, in the scroll compressor according to Embodiment 1 of the present invention. FIG. 3 illustrates motions of the orbiting scroll in four rotational phases.

A rotational phase θ is defined as an angle formed by a straight line L1 and a straight line L2. The straight line L1 is a straight line that connects a base circle center 204*a*-1 of the orbiting spiral element 1*b* at the start of compression to the base circle center 204*b* of the fixed spiral element 2*b*. L2 is a straight line that connects the base circle center 204*a* of the orbiting spiral element 1*b* at a given timing to the base circle center 204*b* of the fixed spiral element 2*b*. The rotational phase θ is 0 degrees at the start of compression, and changes from 0 degrees to 360 degrees during one rotation of the orbiting scroll 1. It should be noted that (A) to (D) in FIG. 3 illustrate respective orbital motions of the orbiting spiral element 1*b* which are performed when the rotational phase θ changes from 0 degrees to 90 degrees, from 90 degrees to 180 degrees, and then from 180 degrees to 270 degrees.

When the glass terminal (not illustrated) in the sealed container 100 is supplied with an electric current, the rotation shaft 6 is rotated by the motor rotator 110*b*. The torque is transmitted through the eccentric shaft portion 6*a* to the orbiting bearing 1*c*, and further transmitted from the orbiting bearing 1*c* to the orbiting scroll 1. As a result, the orbiting scroll 1 performs an orbital motion. Refrigerant gas sucked through the suction pipe 101 into the sealed container 100 is introduced into the compression mechanism 8.

FIG. 3, (A), shows that of the plurality of compression chambers 71, a pair of outermost compression chambers 71, that is, the compression chamber 71*a* and the compression chamber 71*b*, are closed to end the suction of refrigerant. The compression chambers 71*a* and 71*b*, which are outermost compression chambers, will be referred to. As the orbital motion of the orbiting scroll 1 proceeds, the volumes of the compression chambers 71*a* and 71*b* decrease while the compression chambers 71*a* and 71*b* are moving from the outer edge toward the center, as illustrated in (A), (B) and (C) in FIG. 3. The refrigerant gas in the compression chambers 71*a* and 71*b* is compressed as the volumes of the compression chambers 71*a* and 71 *b* decrease. Thus, in the spiral structure 8*a*, the compression is carried out by the orbital motion of the orbiting scroll 1, in the swirling direction of the orbiting scroll 1, which is indicated by the arrow, in FIG. 2. In (B) and (C) in FIG. 3, the compression chambers 71*a*2 and 71*b*2 communicate with each other to form the innermost chamber. As described above, the innermost chamber communicates with the discharge port 200 which is provided as illustrated in FIG. 1, and the compressed refrigerant is discharged into the discharge space 75 through the discharge valve 11.

Figure 5:
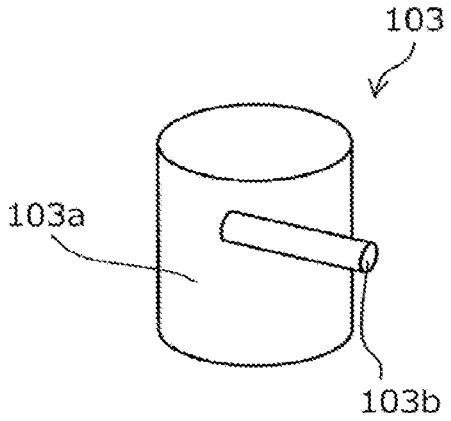
FIG. 5 is a perspective view illustrating the oil separating mechanism of the scroll compressor according to Embodiment 1 of the present invention.
Figure 6:
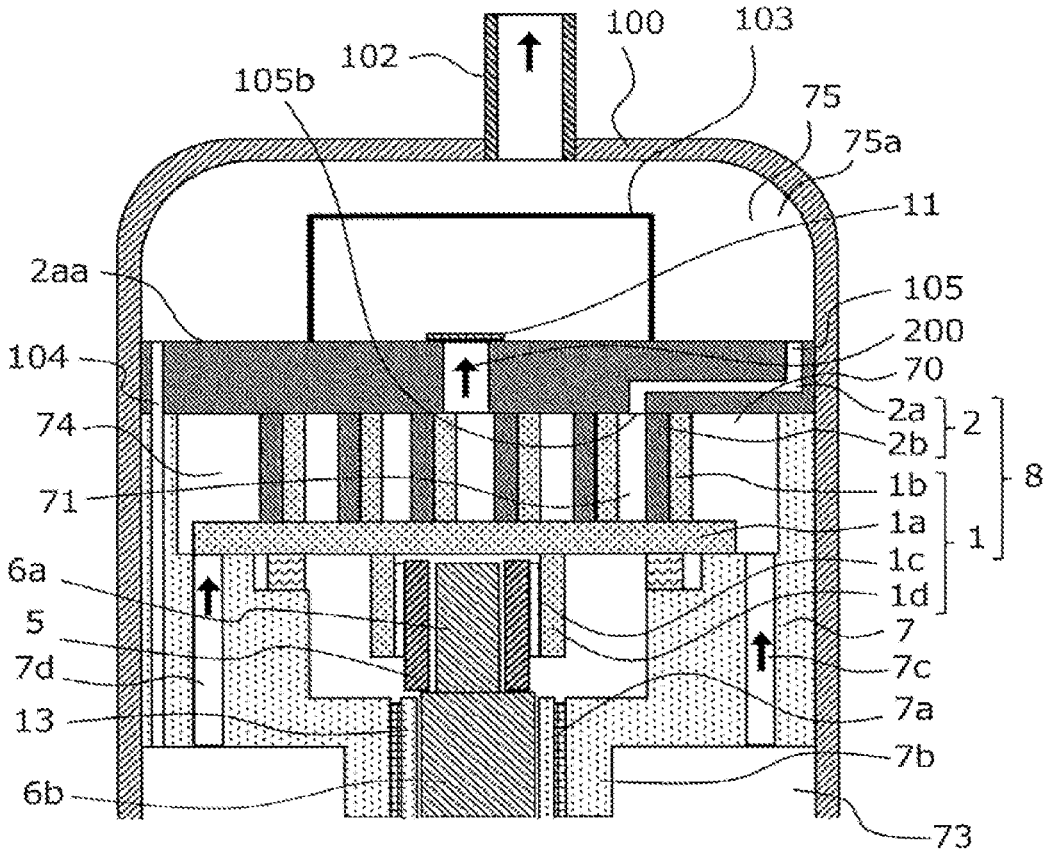
FIG. 6 is a schematic vertical cross-sectional view taken along line B-O-B in FIG. 4.

Next, with reference to FIGS. 4 to 6, the oil separating mechanism 103 and the first and second flow passages 104 and 105 will be described. The first and second flow passages 104 and 105 are features of Embodiment 1 and oil flow passages for oil separated by the oil separating mechanism 103.

Figure 4:
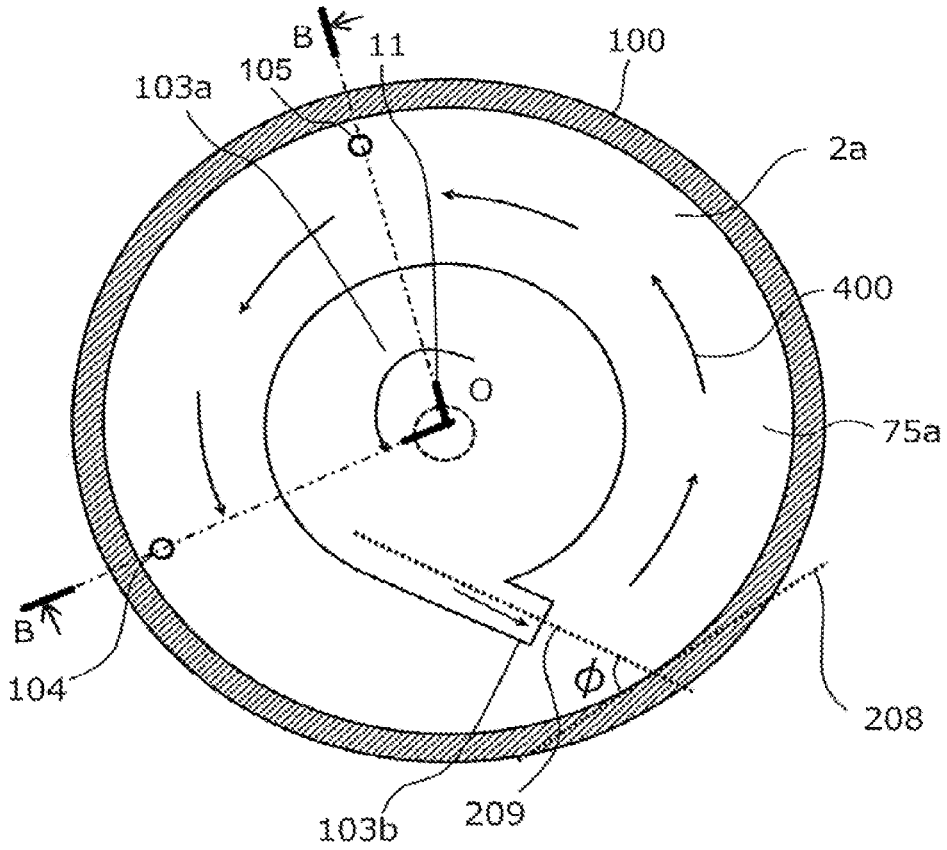
FIG. 4 is a schematic horizontal cross-sectional view illustrating an oil separating mechanism and the vicinity thereof in the scroll compressor according to Embodiment 1 of the present invention.

FIG. 4 is a schematic horizontal cross-sectional view illustrating the oil separating mechanism and the vicinity thereof in the scroll compressor according to Embodiment 1 of the present invention. FIG. 5 is a perspective view illustrating the oil separating mechanism of the scroll compressor according to Embodiment 1 of the present invention. FIG. 6 is a schematic vertical cross-sectional view taken along line B-O-B in FIG. 4.

The oil separating mechanism 103 includes a cylindrical guide container 103*a* having a closed upper surface. The guide container 103*a* has a blowoff port (not illustrated), to which a circular tubular blowoff portion 103*b* is connected. The guide container 103*a* is provided on the back surface 2*aa* of the fixed base plate 2*a*, as illustrated in FIG. 1, to cover the discharge port 200. In the discharge space 75, a cylindrical space around the outer periphery of the guide container 103*a* is an oil separation space 75*a*. The oil separating mechanism 103 may be configured to blow out the refrigerant through the blowoff port (not illustrated) of the guide container 103*a*, without having the blowoff portion 103*b*.

In the oil separating mechanism 103 having the above configuration, the refrigerant discharged from the discharge port 200 into the guide container 103*a* is blown out through the blowoff portion 103*b* into the oil separation space 75*a*. The refrigerant blown out into the oil separation space 75*a* forms a swirl flow. An arrow 400 in FIG. 4 represents the swirl flow. An angle formed by a tangent 208 to the inner wall of the sealed container 100 and a blowoff direction 209 from the blowoff portion 103*b* is defined as an incidence angle ϕ. The smaller the incidence angled), the more easily the swirl flow generates. When centrifugal force acts on the swirl flow, the refrigerating machine oil in the refrigerant is separated from the refrigerant. The separated refrigerating machine oil collects on the back surface 2*aa* of the fixed base plate 2*a* in the oil separation space 75*a*.

The refrigerating machine oil collecting on the back surface 2*aa* of the fixed base plate 2*a* is returned to the oil sump 100*a* through the first flow passage 104, and at the same time, supplied into the compression mechanism 8 through the second flow passage 105. The first flow passage 104 and the second flow passage 105 will now be described.

The first flow passage 104 is a flow passage which extends through the fixed base plate 2*a* and the frame 7 in the axial direction, and through which the oil separation space 75*a* and the suction space 73 communicate with each other, thereby enabling the refrigerating machine oil in the oil separation space 75*a* to return to the oil sump 100*a*.

The second flow passage 105 is a flow passage which extends through the fixed base plate 2*a*, and through which the oil separation space 75*a* to communicate with the inside of the compression mechanism 8, thereby enabling the refrigerating machine oil in the oil separation space 75*a* to be supplied into the compression mechanism 8. FIG. 6 illustrates a configuration in which the second flow passage 105 communicates with the inside of the compression chamber 71 having an intermediate pressure, in the compression mechanism 8. The intermediate pressure is a pressure between the suction pressure and the discharge pressure.

Because of the configuration described above, the refrigerating machine oil collecting on the back surface 2*aa* of the fixed base plate 2*a* is returned to the oil sump 100*a* through the first flow passage 104, and at the same time, is supplied to the compression chamber 71 in the compression mechanism 8 through the second flow passage 105. Therefore, the level of the sealing performance of the compression chamber 71 in the compression mechanism 8 can be increased higher than that of a configuration in which the entire refrigerating machine oil collecting on the back surface 2*aa* of the fixed base plate 2*a* is returned to the oil sump 100*a*. Thus, it is possible, particularly during a low-speed operation, to reduce degradation of the sealing performance in the compression mechanism 8, reduce the leakage of refrigerant from the high-pressure side to the low-pressure side, and improve the performance of the compressor. Hereinafter, the leakage of refrigerant from the high-pressure side to the low-pressure side may be referred to as "high-to-low pressure leakage."

It is conceivable that in order to further improve the sealing performance of the compression chamber 71 in the compression mechanism 8, the entire refrigerating machine oil on the back surface 2*aa* is returned into the compression mechanism 8. However, in this case, oil is excessively supplied to the compression mechanism 8 during a high-speed operation, thus increasing an oil loss, which is a phenomenon where a lubricant in the compressor is discharged out of the compressor. Consequently, the oil sump 100*a* easily runs out of refrigerating machine oil, as a result of which lubrication of the sliding portion is not sufficiently performed. Thus, the reliability may be decreased.

By contrast, in Embodiment 1, the refrigerating machine oil collecting on the back surface 2*aa* is returned to the oil sump 100*a* through the first flow passage 104, and at the same time, is supplied into the compression mechanism 8. It is therefore possible to reduce the oil loss caused by excessive supply of oil during the high-speed operation, and also to reduce the occurrence of high-to-low pressure leakage during the low-speed operation.

Figure 7:
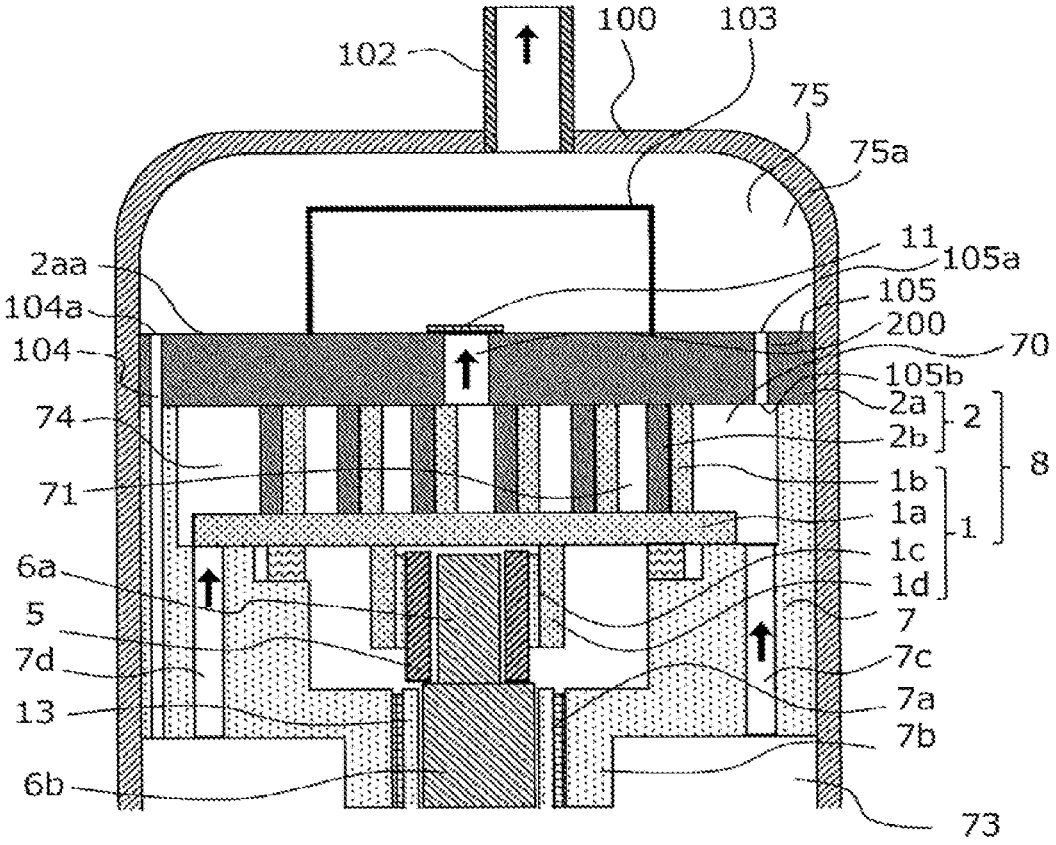
FIG. 7 is a schematic vertical cross-sectional view illustrating another configuration of the compression mechanism and the vicinity thereof in the scroll compressor according to Embodiment 1 of the present invention.

It should be noted that the position of an opening 105*b* of the second flow passage 105 on the low-pressure side is not limited to a position where the opening 105*a* communicates with the compression chamber 71, and the opening 105*b* may also be formed at the position indicated in FIG. 7.

FIG. 7 is a schematic vertical cross-sectional view illustrating another configuration example of the compression mechanism and the vicinity thereof in the scroll compressor according to Embodiment 1 of the present invention.

As illustrated in FIG. 7, the opening 105*b* of the second flow passage 105 on the low-pressure side may be formed in such a manner as to communicate with the suction chamber 70 in the compression mechanism 8. In this case, the refrigerating machine oil collecting on the back surface 2*aa* of the fixed base plate 2*a* flows into the suction chamber 70 through the second flow passage 105. Regarding the formation of the second flow passage 105, it suffices that the second flow passage 105 is formed to allow the oil separation space 75*a* to communicate with the suction chamber 70. Therefore, the second flow passage 105 can be made simply by linearly drilling through the frame 7 in the axial direction, as illustrated in FIG. 7. Formation of the second flow passage 105 as illustrated in FIG. 7 can thus be achieved by drilling processing which is easier than that for the second flow passage 105 that is bent as illustrated in FIG. 6.

That is, it suffices that the second flow passage 105 is provided to cause the refrigerating machine oil collecting on the back surface 2*aa* of the fixed base plate 2*a* to be supplied either to the suction chamber 70 or to the compression chamber 71; that is, the second flow passage 105 is provided to cause the refrigerating machine oil to be supplied into the compression mechanism 8.

For each of the first flow passage 104 and the second flow passage 105, the position of an opening adjoining the oil separation space 75*a* (which will be hereinafter referred to as the opening on the high-pressure side) will be described.

Figure 8:
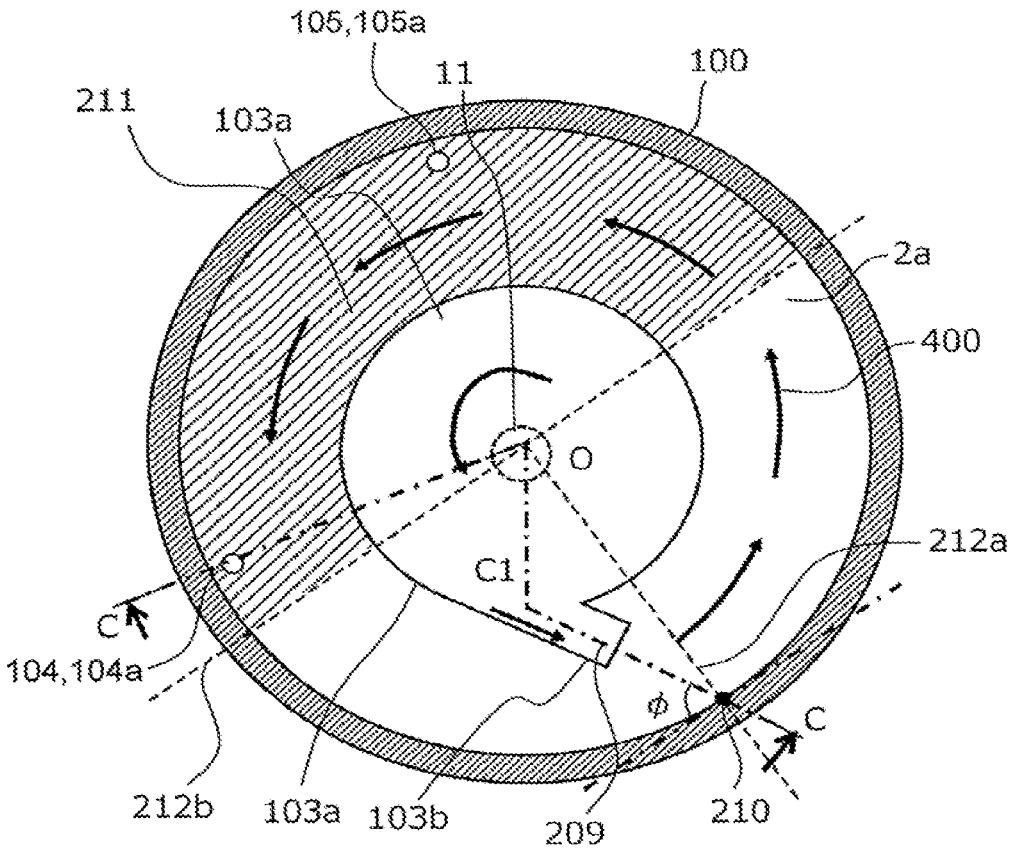
FIG. 8 is a schematic horizontal cross-sectional view illustrating a discharge space and the vicinity thereof in the scroll compressor according to Embodiment 1 of the present invention.
Figure 9:
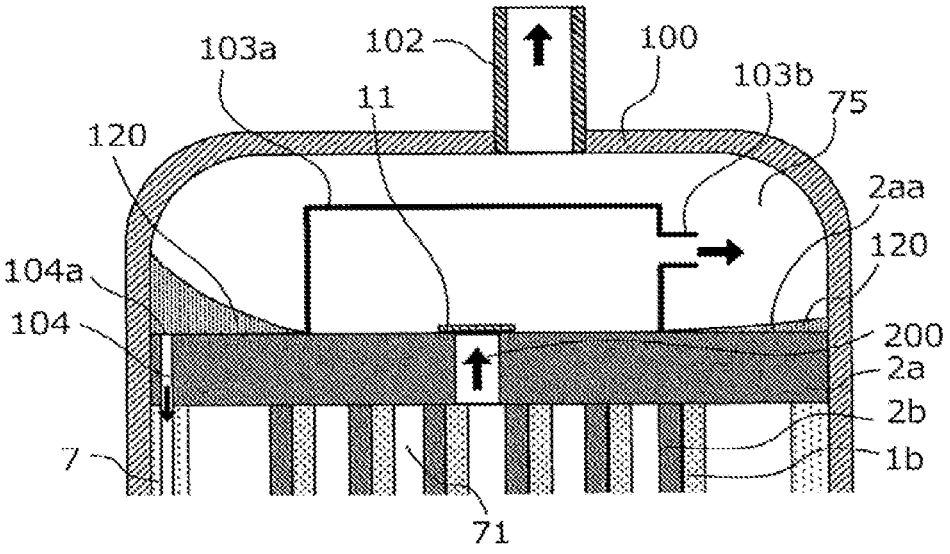
FIG. 9 is a schematic vertical cross-sectional view taken along line C-O-C1-C in FIG. 8.

FIG. 8 is a schematic horizontal cross-sectional view illustrating the discharge space and the vicinity thereof in the scroll compressor according to Embodiment 1 of the present invention. FIG. 9 is a schematic vertical cross-sectional view taken along line C-O-C1-C in FIG. 8.

The refrigerant blown out of the blowoff portion 103*b* collides with the sealed container 100 in an area centering around a blowoff collision point 210 where an extension line in the blowoff direction from the blowoff portion 103*b* intersects the inner wall of the sealed container 100.

As described above, during the operation of the scroll compressor 30, the refrigerating machine oil separated from the refrigerant necessarily collects on the fixed base plate 2*a*. FIG. 9 illustrates a refrigerating machine oil 120 collecting on the fixed base plate 2*a*.

In the case where refrigerant discharged from the blowoff portion 103*b* flows at a high velocity, the refrigerating machine oil collecting on the fixed base plate 2*a* may be made by the refrigerant to fly off, and may not collect in the area around the blowoff collision point 210. In the case where the openings 104*a* and 105*a* of the first flow passage and the second flow passage on the high-pressure side are provided in an area where no refrigerating machine oil collects, the first flow passage 104 and the second flow passage 105 are not filled with the refrigerating machine oil. In this case, the first flow passage 104 communicates with the low-pressure space, and the second flow passage 105 communicates with an intermediate-pressure space or the low-pressure space. Therefore, high-pressure gas refrigerant in the discharge space 75 may leak therefrom to the low-pressure side through the first flow passage 104 and the second flow passage 105.

It is therefore preferable that the opening 104*a* and the opening 105*a* of the first flow passage 104 and the second flow passage 105 on the high-pressure side be provided in an area other than an area where the refrigerating machine oil does not easily collect. Specifically, referring to FIG. 8, in the case where an annular region of the fixed base plate 2*a* that is located outside the guide container 103*a* is divided into two regions with respect to a straight line 212*b* (described below), one of these regions that has the blowoff collision point 210 is the above area where the refrigerating machine oil does not easily collect. The straight line 212*b* is a straight line that perpendicularly intersects a straight line 212*a* at a center O of the fixed base plate 2*a* as the fixed base plate 2*a* is viewed in the axial direction, the straight line 212*a* extending through the center O of the fixed base plate 2*a* and the blowoff collision point 210. It is thus preferable that the openings 104*a* and 105*a* be provided in a region (hereinafter referred to as a non-blowoff region 211) opposite to the region having the blowoff collision point 210.

Since the openings 104*a* and 105*a* of the first flow passage 104 and the second flow passage 105 on the high-pressure side are provided in the non-blowoff region 211, each of the first flow passage 104 and the second flow passage 105 is filled with refrigerating machine oil during the operation. As a result, it is possible to reduce leakage of refrigerant from the high-pressure side to the low-pressure side in the compression mechanism 8, and thus to provide a compressor having a high performance.

Next, the position where the discharge pipe 102 is connected to the sealed container 100 will be described.

Figure 10:
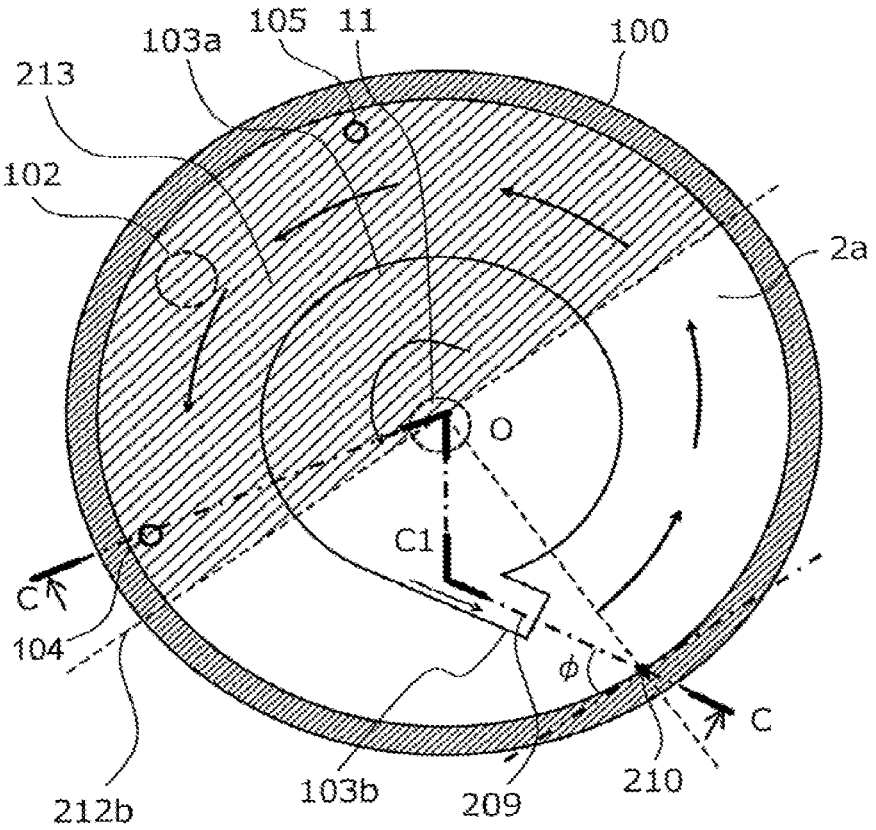
FIG. 10 is a schematic horizontal cross-sectional view illustrating the compression mechanism and the vicinity thereof in the scroll compressor according to Embodiment 1 of the present invention.

FIG. 10 is a schematic horizontal cross-sectional view illustrating the compression mechanism and the vicinity thereof in the scroll compressor according to Embodiment 1 of the present invention. As a matter of convenience for explanation, FIG. 10 indicates where the discharge pipe 102 is connected to the sealed container 100 as the scroll compressor is viewed in the axial direction.

As described above, the refrigerating machine oil collecting on the fixed base plate 2*a* is easily made to fly off in the vicinity of the blowoff collision point 210. Therefore, in the case where the discharge pipe 102 is connected in the vicinity of the blowoff collision point 210, the refrigerating machine oil made to fly off is discharged through the discharge pipe 102 to the outside; that is, a so-called oil loss easily occurs.

Therefore, it is preferable that at the upper surface of the sealed container 100, the discharge pipe 102 be connected to a position where occurrence of oil loss can be avoided. Specifically, in the case where the upper surface of the sealed container 100 is divided into two regions with respect to the straight line 212*b*, the discharge pipe 102 is connected to the region (hereinafter referred to as a non-blowoff region 213)

opposite to the region having the blowoff collision point 210. Thereby, it is possible to reduce the occurrence of oil loss.

As described above, in Embodiment 1, in addition to the first flow passage 104 that causes the refrigerating machine oil separated by the oil separation space 75*a* to return to the oil sump 100*a*, the second flow passage 105 is provided to cause the refrigerating machine oil to be supplied into the compression mechanism 8. Thus, it is possible to improve the sealing performance of the compression chamber 71. It is therefore possible, particularly during the low-speed operation, to reduce leakage of refrigerant from the high-pressure side to the low-pressure side, and improve the performance of the compressor.

The refrigerating machine oil 120 in the oil separation space 75*a* is also returned to the oil sump 100*a*; that is, the refrigerating machine oil 120 in the oil separation space 75*a* is not entirely supplied to the compression mechanism 8. Therefore, particularly during the high-speed operation where oil loss increases, the possibility that the oil sump 100*a* will run out of refrigerating machine oil can be reduced, and the reliability can be improved.

It should be noted that the oil separating mechanism 103 also serves as a silencing mechanism, because it prevents the refrigerant discharged from the compression mechanism 8 from directly colliding with the sealed container 100.

Embodiment 2

Embodiment 2 differs from Embodiment 1 in the configuration of the oil separating mechanism 103. The other configurations are the same as those of Embodiment 1. Embodiment 2 will be described by referring only to features different from those of Embodiment 1.

In Embodiment 2, three configuration examples of the oil separating mechanism 103 will be described in turn.

Figure 11:
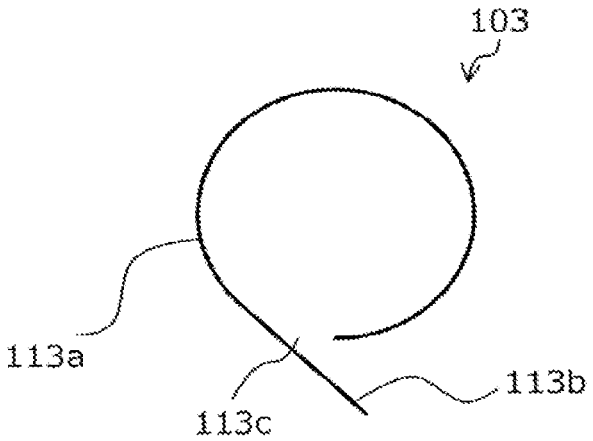
FIG. 11 is a top view illustrating configuration example 1 of an oil separating mechanism of a scroll compressor according to Embodiment 2 of the present invention.

FIG. 11 is a top view illustrating configuration example 1 of an oil separating mechanism of a scroll compressor according to Embodiment 2 of the present invention.

Figure 12:
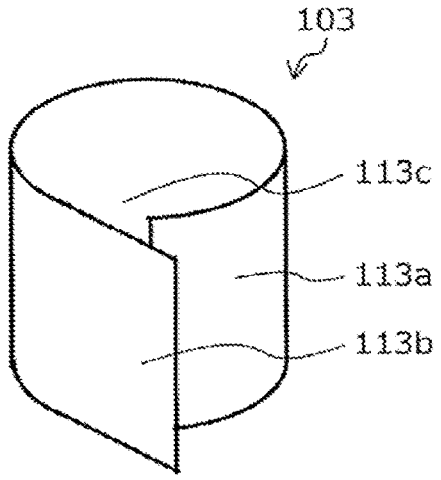
FIG. 12 is a perspective view illustrating configuration example 1 of the oil separating mechanism of the scroll compressor according to Embodiment 2 of the present invention.

FIG. 12 is a perspective view illustrating configuration example 1 of the oil separating mechanism of the scroll compressor according to Embodiment 2 of the present invention.

The oil separating mechanism 103 as illustrated in FIGS. 11 and 12 includes a first wall portion 113*a* formed in the shape of an arched surface and a second wall portion 113*b* formed in a planar shape. To be more specific, the second wall portion 113*b* is continuous with one end of the first wall portion 113*a* in a circumferential direction thereof, and a gap 113*c* serving as a blowoff port is formed between the second wall portion 113*b* and the other end of the first wall portion 113*a* in the circumferential direction. The oil separating mechanism 103 is configured such that the refrigerant flowing out through the gap 113*c* is guided and blown to the outside by the second wall portion 113*b*. The first wall portion 113*a* and the second wall portion 113*b* form a guide container of the present invention.

Figure 13:
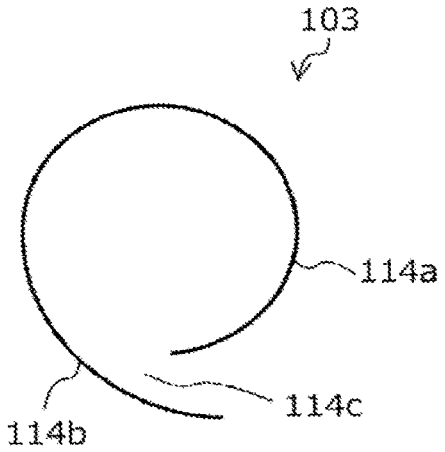
FIG. 13 is a top view illustrating configuration example 2 of the oil separating mechanism of the scroll compressor according to Embodiment 2 of the present invention.
Figure 14:
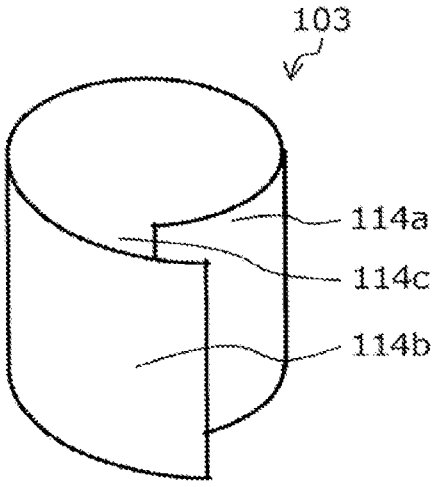
FIG. 14 is a perspective view illustrating configuration example 2 of the oil separating mechanism of the scroll compressor according to Embodiment 2 of the present invention.

FIG. 13 is a top view illustrating configuration example 2 of the oil separating mechanism of the scroll compressor according to Embodiment 2 of the present invention. FIG. 14 is a perspective view illustrating configuration example 2 of the oil separating mechanism of the scroll compressor according to Embodiment 2 of the present invention.

The oil separating mechanism 103 as illustrated in FIGS. 13 and 14 includes a first wall portion 114*a* having an arched shape and a second wall portion 114*b* having an arched shape having a curvature different from that of the first wall portion 114*a*. More specifically, the second wall portion 114*b* is continuous with one end of the first wall portion 114*a* in a circumferential direction thereof, and a gap 114*c* serving as a blowoff port is formed between the second wall portion 114*b* and the other end of the first wall portion 114*a* in the circumferential direction. The oil separating mechanism 103 is configured such that the refrigerant flowing out through the gap 114*c* is guided and blown to the outside by the second wall portion 114*b*. The first wall portion 114*a* and the second wall portion 114*b* form a guide container of the present invention.

Figure 15:
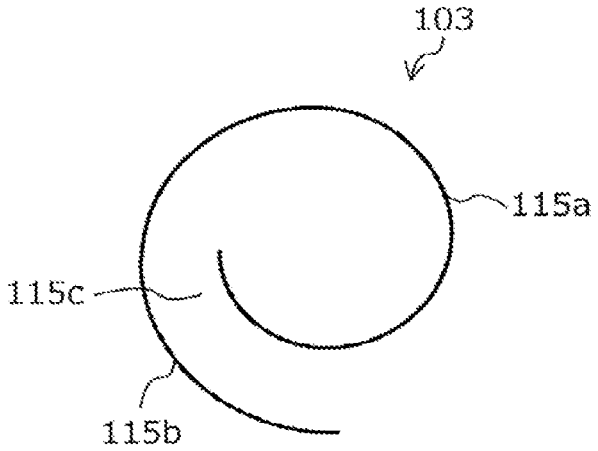
FIG. 15 is a top view illustrating configuration example 3 of the oil separating mechanism of the scroll compressor according to Embodiment 2 of the present invention.
Figure 16:
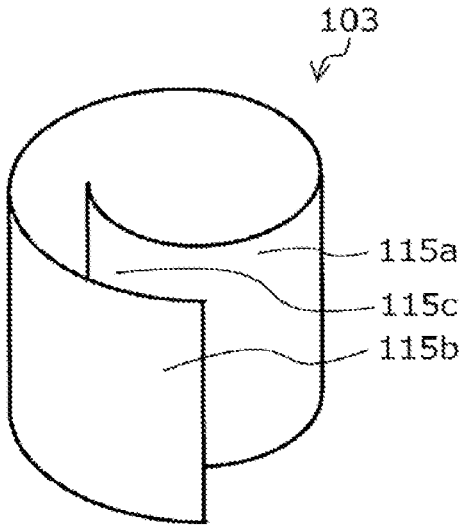
FIG. 16 is a perspective view illustrating configuration example 3 of the oil separating mechanism of the scroll compressor according to Embodiment 2 of the present invention.

FIG. 15 is a top view illustrating configuration example 3 of the oil separating mechanism of the scroll compressor according to Embodiment 2 of the present invention. FIG. 16 is a perspective view illustrating configuration example 3 of the oil separating mechanism of the scroll compressor according to Embodiment 2 of the present invention.

The oil separating mechanism 103 as illustrated in FIG. 15 and FIG. 16 includes a first wall portion 115*a* having an arched shape and a second wall portion 115*b* having an arched shape. To be more specific, the second wall portion 115*b* is continuous with one end of the first wall portion 115*a* in a circumferential direction thereof, and a gap 115*c* serving as a blowoff port is formed between the second wall portion 115*b* and the other end of the first wall portion 115*a* in the circumferential direction. A curved surface formed by coupling the first wall portion 115*a* and the second wall portion 115*b* is a curved surface whose curvature continuously varies. The oil separating mechanism 103 is configured such that the refrigerant flowing out through the gap 115*c* is guided and blown to the outside by the second wall portion 115*b*. The first wall portion 115*a* and the second wall portion 115*b* form a guide container of the present invention.

In the oil separating mechanism 103 as illustrated in FIGS. 11 to 16, the gap extending in the axial direction serves as a blowoff port. It is therefore possible not only to generate a swirl flow that is uniform in the axial direction, but to generate a swirl flow in the discharge space 75 with a simpler structure. The shape of the oil separating mechanism 103 is not limited to the above shape, that is, the oil separating mechanism 103 may have any shape as long as the incidence angle $\phi$ is small and the oil separating mechanism can generate a swirl flow.

Embodiment 3

Embodiment 3 relates to a configuration obtained by adding a swirling-flow assist guide to Embodiment 1. The other configurations are the same as those of Embodiment 1. Embodiment 3 will be described by referring only to features different from those of Embodiment 1.

Figure 17:
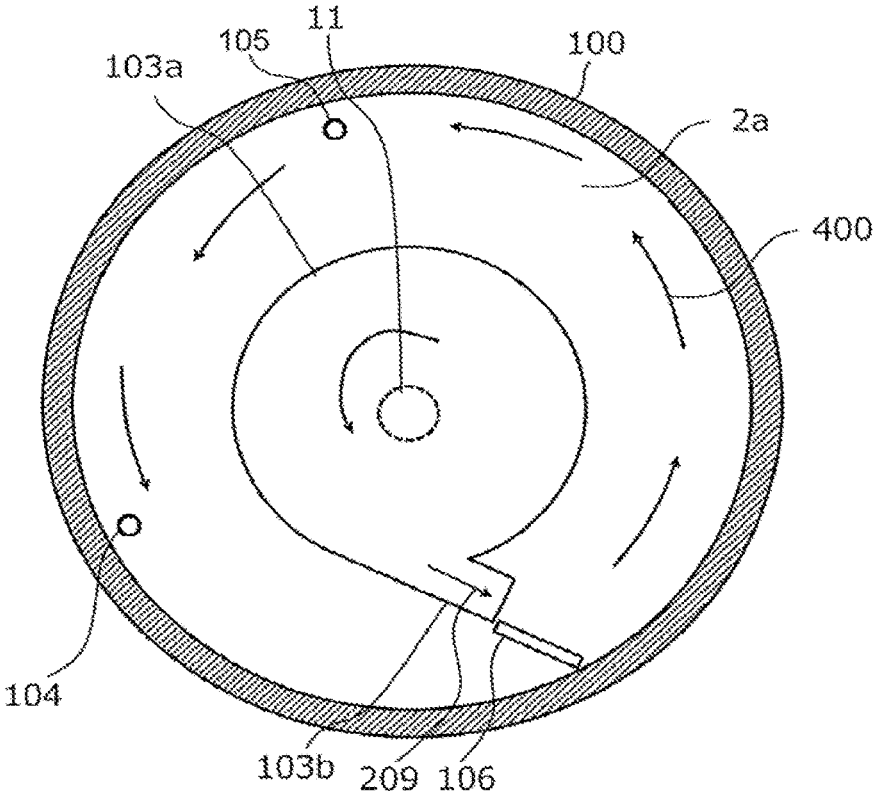
FIG. 17 is a schematic horizontal cross-sectional view illustrating a discharge space and the vicinity thereof that includes a swirling-flow assist guide in a scroll compressor according to Embodiment 3 of the present invention.

FIG. 17 is a schematic horizontal cross-sectional view illustrating a discharge space and the vicinity thereof that includes a swirling-flow assist guide in a scroll compressor according to Embodiment 3 of the present invention.

In Embodiment 3, the oil separating mechanism 103 is provided with a plate-like swirling-flow assist guide 106 at the back surface 2*aa* of the fixed base plate 2*a* in the discharge space 75, in addition to the oil separating mechanism 103. The swirling-flow assist guide 106 is a guide element that assists flowing of the refrigerant blown out from the blowoff portion 103*b* of the oil separating mechanism 103 such that the refrigerant flows in a swirl direction 400. The swirling-flow assist guide 106 is provided as follows. In a flow passage along which the refrigerant blown out from the blowoff portion 103*b* of the oil separating mechanism 103 flows until it collides with an inner surface of the sealed container 100, the swirling-flow assist guide 106 is provided on an opposite side of a side of the flow passage from which the refrigerant blown out of the blowoff portion 103*b* flows in the swirl direction 400, such that the swirling-flow assist guide 106 extends in the blowoff direction 209.

For the refrigerant blown out of the blowoff portion 103*b*, the swirling-flow assist guide 106 provided as described above reduces the flow of the refrigerant in the opposite direction to the swirl direction 400 in the discharge space 75.

In Embodiment 3, it is possible to obtain the same advantageous as or similar advantages to those obtained by Embodiment 1, and because of provision of the swirling-flow assist guide 106, a swirl flow is easily generated in the discharge space 75, thus improving the efficiency of oil separation.

Embodiment 4

Embodiment 4 relates to a configuration obtained by adding swirling-flow assist guides to Embodiment 1. The swirling-flow assist guides of Embodiment 4 have a shape different from that of the swirling-flow assist guide according to Embodiment 3. Embodiment 4 will be described by referring only to features different from those of Embodiment 1.

Figure 18:
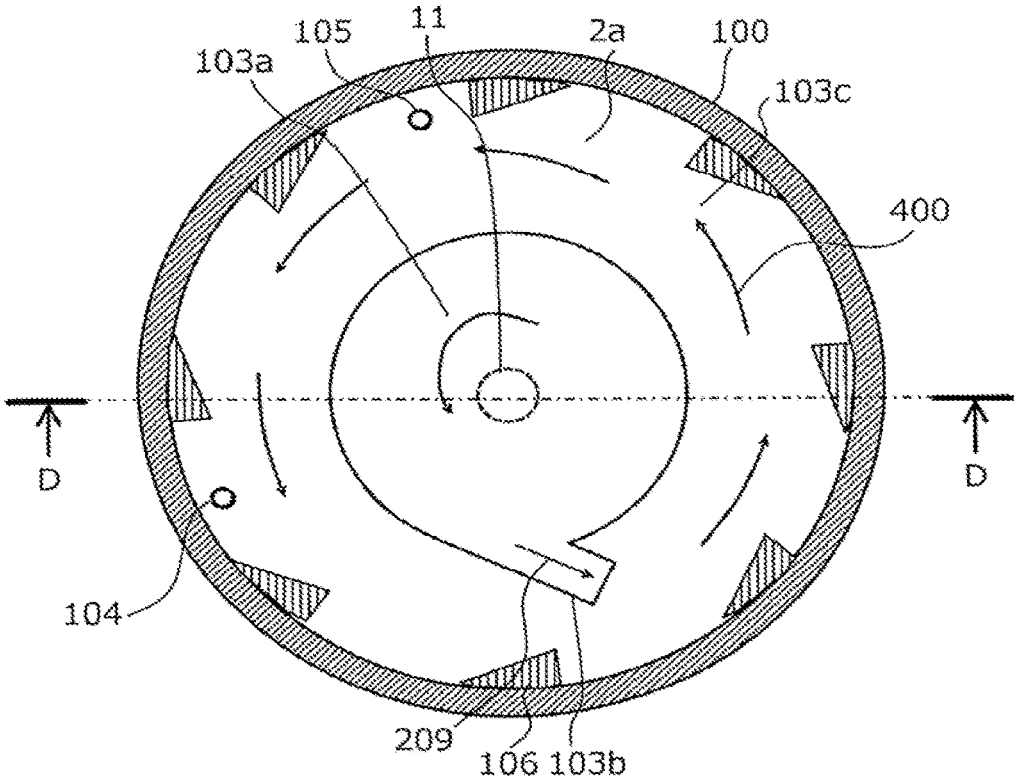
FIG. 18 is a schematic horizontal cross-sectional view illustrating a discharge space and the vicinity thereof that includes swirling-flow assist guides in a scroll compressor according to Embodiment 4 of the present invention.
Figure 19:
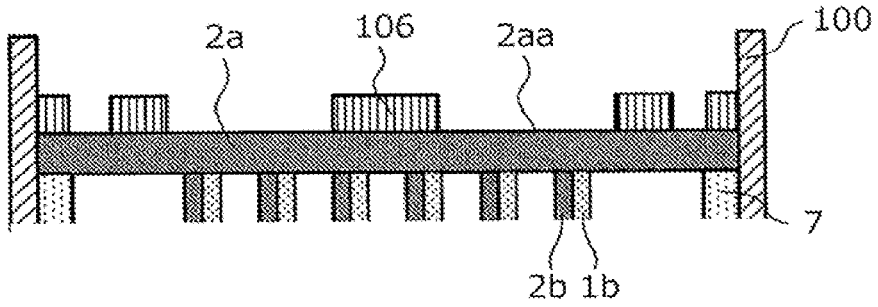
FIG. 19 is a schematic vertical sectional view of a swirling-flow assist guide, which is taken along line D-D in FIG. 18.

FIG. 18 is a schematic horizontal cross-sectional view illustrating a discharge space and the vicinity thereof that includes swirling-flow assist guides in a scroll compressor according to Embodiment 4 of the present invention. FIG. 19 is a schematic vertical sectional view of a swirling-flow assist guide, which is taken along line D-D in FIG. 18.

In Embodiment 4, a plurality of protruding swirling-flow assist guides 106 are formed on an outer periphery of the back surface 2*aa* of the fixed base plate 2*a* and arranged at intervals in the circumferential direction. The height of each of the swirling-flow assist guides 106 from the fixed base plate 2*a* in the axial direction is constant, and each swirling-flow assist guide 106 has a surface inclined inwardly from one of ends of each swirling-flow assist guide 106 to the other in the swirl direction 400, as viewed in the axial direction.

For the refrigerant blown out of the oil separating mechanism 103, the swirling-flow assist guides 106 having the above configuration can reduce the flow of the refrigerant in the opposite direction to the swirl direction 400.

Figure 20:
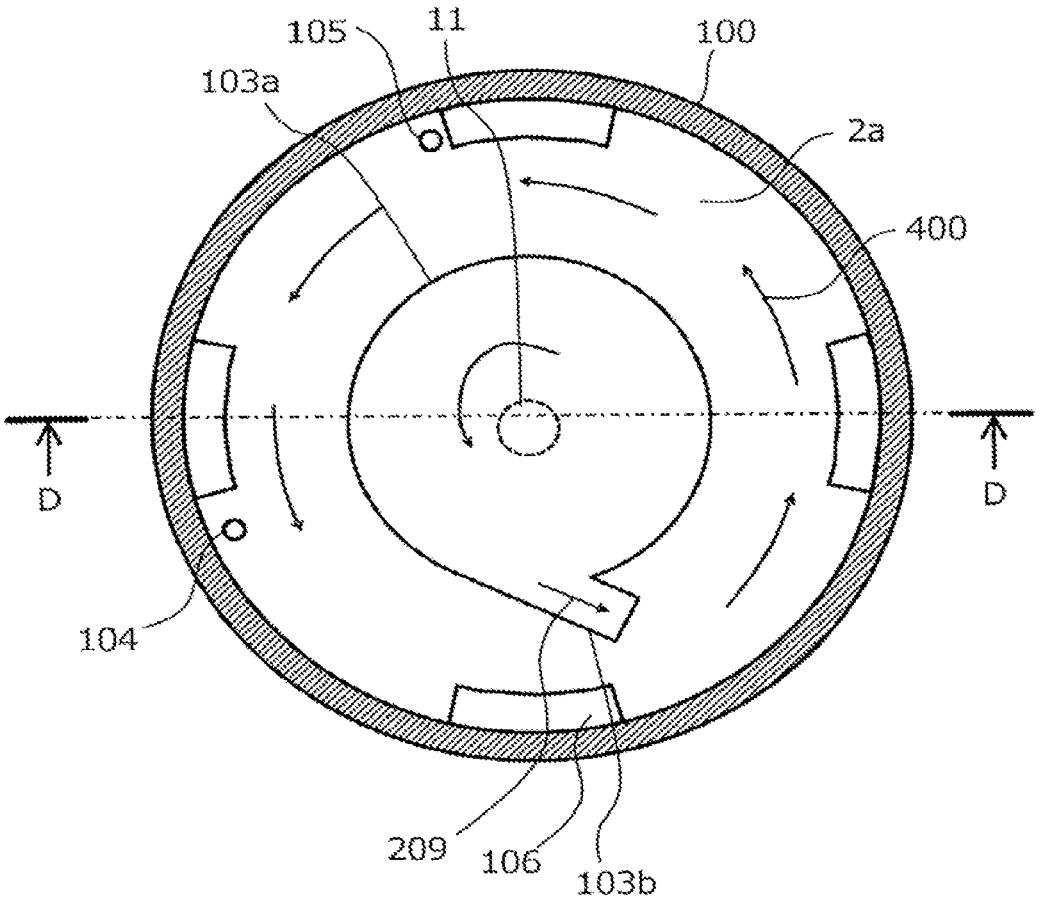
FIG. 20 is a schematic horizontal cross-sectional view illustrating the discharge space and the vicinity thereof that includes swirling-flow assist guides in a modification of the scroll compressor according to Embodiment 4 of the present invention.

FIG. 20 illustrates a modification that includes swirling-flow assist guides 106 having a different shape from that of the swirling-flow assist guides 106 that are provided as illustrated in FIG. 18.

Figure 21:
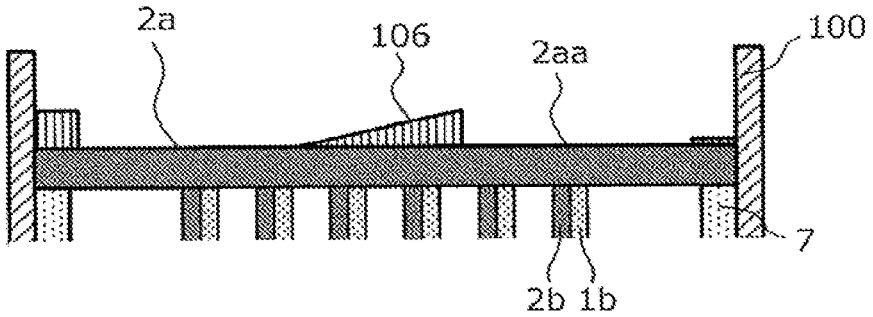
FIG. 21 is a schematic vertical sectional view of a swirling-flow assist guide, which is taken along line D-D in FIG. 20.

FIG. 20 is a schematic horizontal cross-sectional view illustrating a discharge space and the vicinity thereof that includes swirling-flow assist guides in a modification of the scroll compressor according to Embodiment 4 of the present invention. FIG. 21 is a schematic vertical sectional view of a swirling-flow assist guide, which is taken along line D-D in FIG. 20.

The swirling-flow assist guides 106 according to this modification are the same as those as illustrated in FIGS. 18 and 19 on the point that a plurality of protruding swirling-flow assist guides 106 are provided on an outer periphery of the back surface 2*aa* of the fixed base plate 2*a* and arranged at intervals in the circumferential direction. However, in the modification, the height of each of the swirling-flow assist guides 106 from the fixed base plate 2*a* increases from one of ends of each swirling-flow assist guide 106 to the other in the swirl direction 400, and the thickness of each swirling-flow assist guide 106 in the radial direction is constant.

Also, in this configuration, for the refrigerant blown out of the oil separating mechanism 103, it is possible to reduce the flow of the refrigerant in the opposite direction to the swirl direction 400.

In Embodiment 4, it is possible to obtain the same advantageous as or similar advantages to those of Embodiment 1. In addition, because of provision of the swirling-flow assist guides 106, a swirl flow is more easily generated in the discharge space 75, and the efficiency of oil separation can be improved.

The swirling-flow assist guide 106 of Embodiment 3 acts on the refrigerant only immediately after the refrigerant is discharged. By contrast, in Embodiment 4, since a plurality of swirling-flow assist guides 106 are arranged in the circumferential direction, the flow of the refrigerant can be controlled at the position of each of the swirling-flow assist guides 106, and the efficiency of oil separation can be further improved.

Embodiment 5

Embodiment 5 differs from Embodiments 1 to 4 in the positional relationship between the first flow passage 104 and the second flow passage 105. Embodiment 5 will be described by referring only to features of Embodiment 5, and the descriptions of the other points thereof will be omitted.

Figure 22:
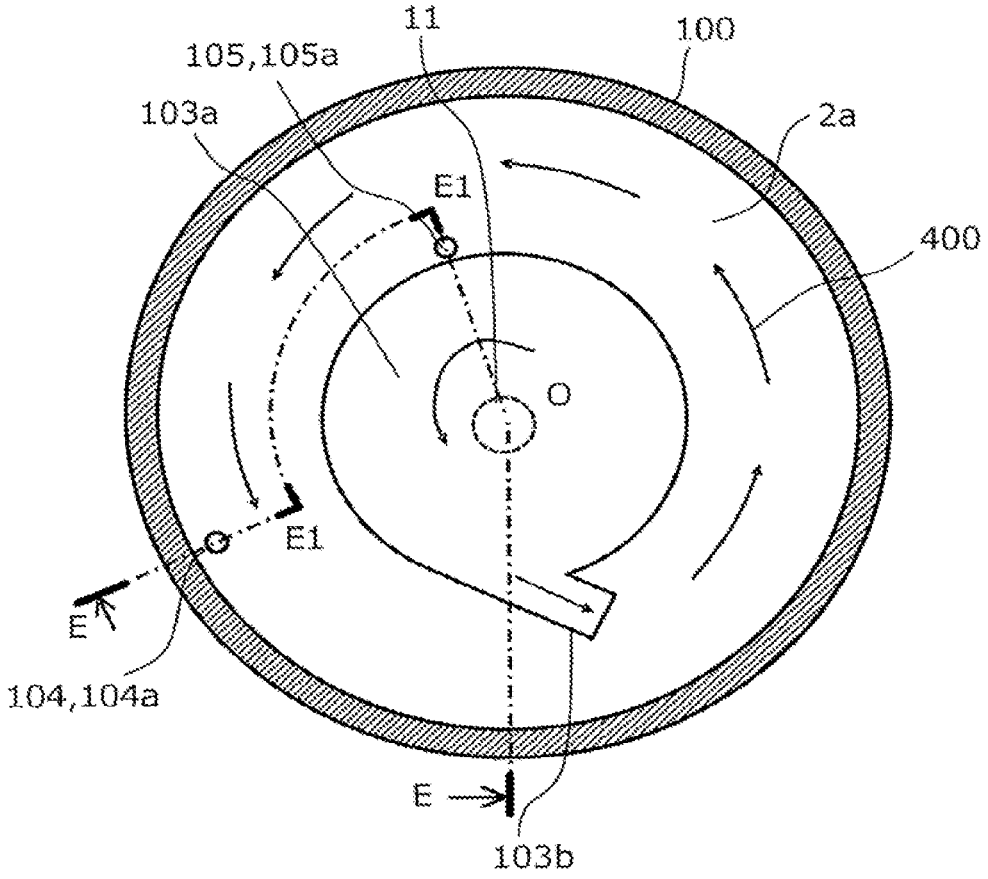
FIG. 22 is a schematic horizontal cross-sectional view illustrating an oil separating mechanism and the vicinity thereof in a scroll compressor according to Embodiment 5 of the present invention.
Figure 23:
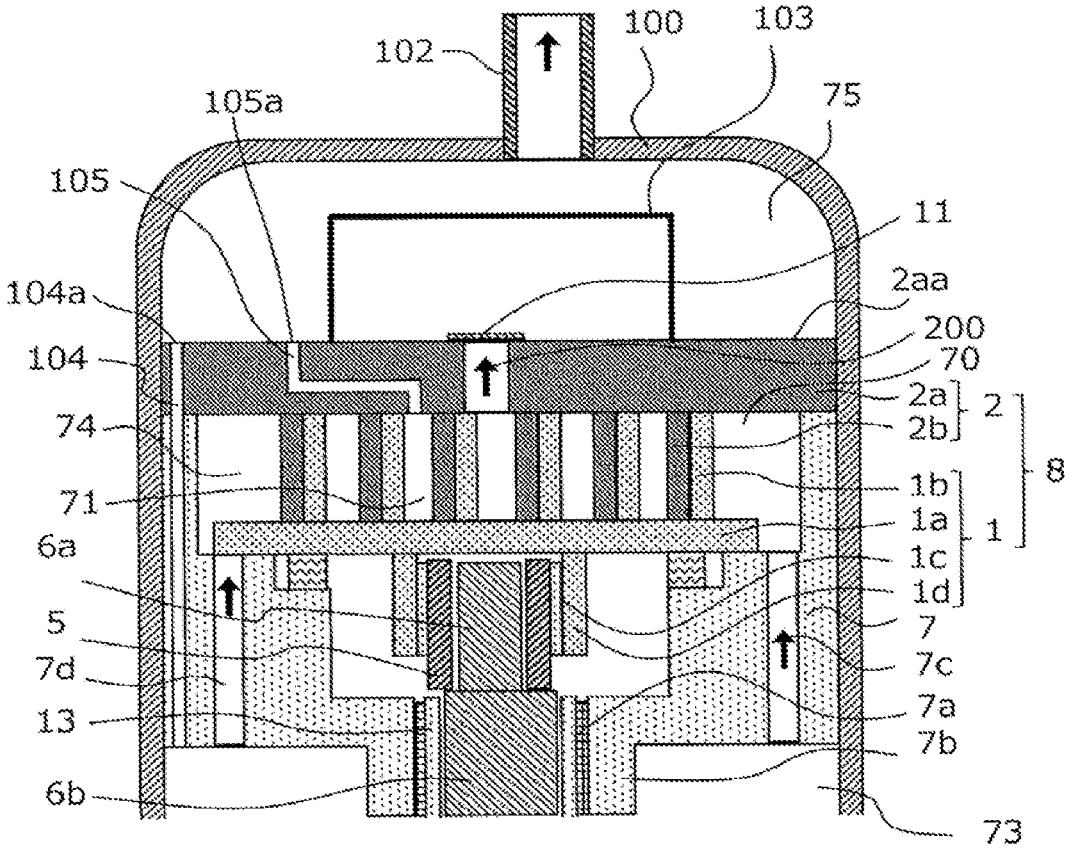
FIG. 23 is a schematic vertical cross-sectional view taken along line E-E1-E1-O-E in FIG. 22.
Figure 24:
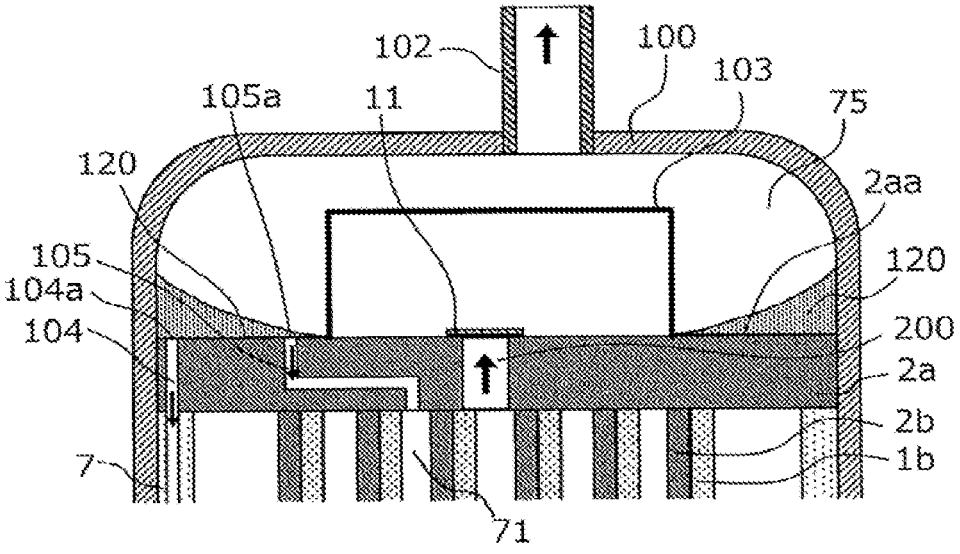
FIG. 24 is a schematic vertical cross-sectional view illustrating a state of refrigerating machine oil in the discharge space during a high-speed operation in the scroll compressor according to Embodiment 5 of the present invention.
Figure 25:
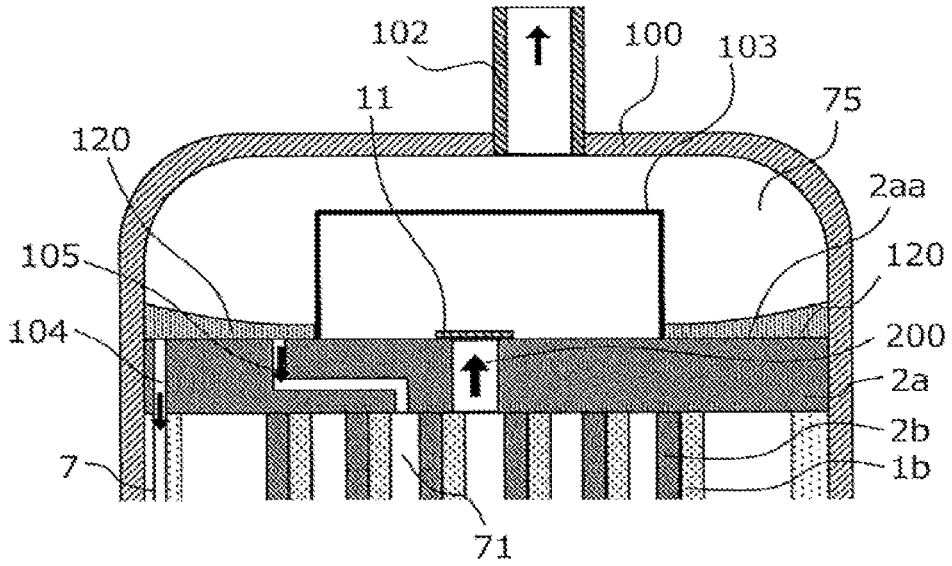
FIG. 25 is a schematic vertical cross-sectional view illustrating a state of refrigerating machine oil in the discharge space during a low-speed operation in the scroll compressor according to Embodiment 5 of the present invention.

FIG. 22 is a schematic horizontal cross-sectional view illustrating an oil separating mechanism and the vicinity thereof in a scroll compressor according to Embodiment 5 of the present invention. FIG. 23 is a schematic vertical cross-sectional view taken along line E-E1-E1-O-E in FIG. 22. FIG. 24 is a schematic vertical cross-sectional view illustrating a state of refrigerating machine oil in the discharge space during a high-speed operation in the scroll compressor according to Embodiment 5 of the present invention. FIG. 25 is a schematic vertical cross-sectional view illustrating a state of refrigerating machine oil in the discharge space during a low-speed operation in the scroll compressor according to Embodiment 5 of the present invention.

In Embodiment 5, the second flow passage 105 is formed by drilling through the fixed base plate 2*a* in such a manner that the opening 105*a* of the second flow passage 105 on the high-pressure side is located inward of the opening 104*a* of the first flow passage 104 in the radial direction, which adjoins the discharge space 75.

As illustrated in FIG. 24, during the high-speed operation, since the velocity of the swirl flow of refrigerant in the discharge space 75 is high, the refrigerating machine oil 120 in the discharge space 75 is unevenly distributed to an outer side in the radial direction. By contrast, as illustrated in FIG. 25, during the low-speed operation, since the velocity of the swirl flow of refrigerant in the discharge space 75 is low, the unevenness of the distribution of the refrigerating machine oil 120 in the radial direction is reduced.

The oil sump 100*a* easily run out of refrigerating machine oil during the high-speed operation, in which oil loss increases. Therefore, for the first flow passage 104 that is a flow passage to return the refrigerating machine oil to the oil sump 100*a*, it is preferable that the opening of the first flow passage 104 on the high-pressure side be located on the outer side of the back surface 2*aa* of the fixed base plate 2*a* in the radial direction, because the refrigerating machine oil is distributed to and accumulates on the outer side during the high-speed operation.

As for the second flow passage 105 that is a flow passage to supply the refrigerating machine oil into the compression mechanism 8, preferably, the opening 105*a* on the high-pressure side should be provided as follows. It should be noted that sealing of the compression mechanism 8 with the refrigerating machine oil is more necessary during the low-speed operation, in which the influence of deterioration of the performance which is caused by high-to-low pressure leakage is great. By contrast, if the refrigerating machine oil is excessively supplied to the compression chamber 71 during the high-speed operation, even though the sealing performance in the compression mechanism 8 is improved, the compression loss of the supplied refrigerating machine oil may increase, and the performance of the compressor may deteriorate.

Therefore, in Embodiment 5, in order to ensure a given amount of oil to be supplied into the compression mechanism 8 during the low-speed operation, rather than during the high-speed operation, the opening 105*a* of the second flow passage 105 on the high-pressure side is located inward of the opening 104*a* of the first flow passage 104 on the high-pressure side in the radial direction.

In embodiment 5, in addition to the advantages of Embodiment 1, it is possible to reduce the possibility that the oil sump 100*a* will run out of refrigerating machine oil, and thus can obtain a scroll compressor having a high reliability. It is also possible to reduce the compression loss of the refrigerating machine oil, and obtain a scroll compressor having a high performance.

Embodiment 6

Embodiment 6 relates to a refrigeration cycle apparatus provided with any of the above scroll compressors.

Figure 26:
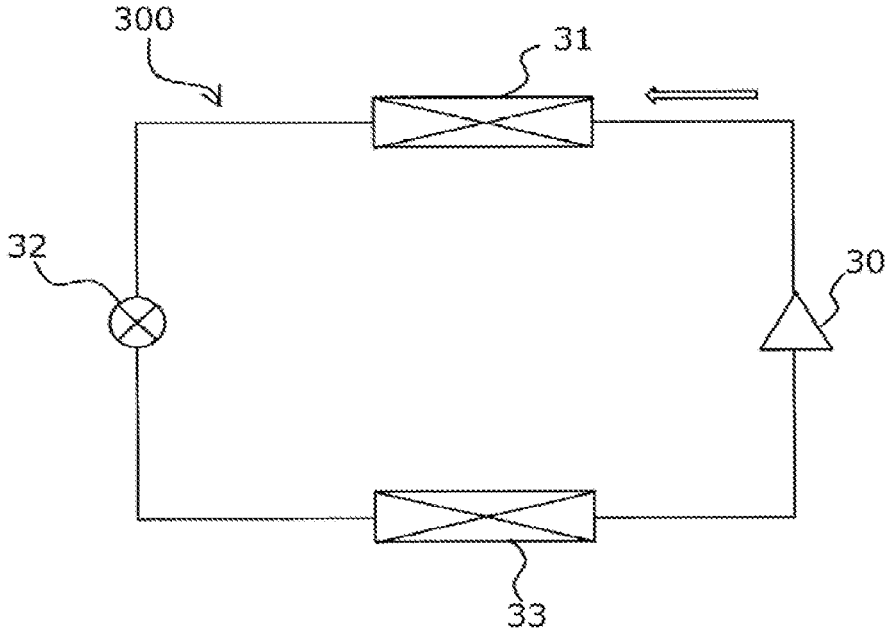
FIG. 26 is a diagram illustrating a refrigeration cycle apparatus according to Embodiment 6 of the present invention.

FIG. 26 is a diagram illustrating an example of a refrigeration cycle apparatus according to Embodiment 6 of the present invention. In FIG. 26, an arrow indicates the flow direction of the refrigerant.

A refrigeration cycle apparatus 300 as illustrated in FIG. 26 includes a circuit in which the scroll compressor 30, a condenser 31, an expansion valve 32 serving as a pressure-reducing device, and an evaporator 33 are sequentially connected by pipes to allow refrigerant to circulate. As the scroll compressor 30, the scroll compressor 30 according to any one of Embodiment 1 to Embodiment 5 described above is used. The opening degree of the expansion valve 32 and the rotation speed of the scroll compressor 30 are controlled by a controller (not illustrated).

The refrigeration cycle apparatus 300 may further include a four-way valve (not illustrated) to reverse the flow direction of refrigerant. In this case, in the case where the condenser 31 located downstream of the scroll compressor 30 is provided in the indoor unit and the evaporator 33 is provided in the outdoor unit, the heating operation is performed; and in the case where the condenser 31 is provided in the outdoor unit and the evaporator 33 is provided in the indoor unit, the cooling operation is performed.

Hereinafter, it is assumed that a circuit including the scroll compressor 30, the condenser 31, the expansion valve 32, and the evaporator 33 as illustrated in FIG. 26 is a main circuit, and refrigerant that circulates in the main circuit is a main refrigerant.

The flow of the main refrigerant will now be described.

In the main circuit, the main refrigerant discharged from the scroll compressor 30 passes through the condenser 31, the expansion valve 32, and the evaporator 33 and returns to the scroll compressor 30. When returning to the scroll compressor 30, the refrigerant flows into the sealed container 100 through the suction pipe 101.

After flowing into the suction space 73 in the sealed container 100 through the suction pipe 101, the low-pressure refrigerant passes through the two refrigerant inlets 7*d* and 7*c* provided in the frame 7 to flow into the suction chamber 70 in the compression mechanism 8. The low-pressure refrigerant in the suction chamber 70 is sucked into the compression chamber 71 because of a relative orbital motion of the orbiting spiral element 1*b* and the fixed spiral element 2*b* of the compression mechanism 8. After the main refrigerant is sucked into the compression chamber 71, the pressure of the main refrigerant is raised from a low pressure to a high pressure by a change in the geometrical volume of the compression chamber 71 that accompanies the relative motion of the orbiting spiral element 1*b* and the fixed spiral element 2*b*. Then, the main refrigerant whose pressure has been raised to the high pressure pushes the discharge valve 11 to open it, and is discharged into the discharge space 75. Thereafter, the refrigerant passes through the discharge pipe 102, and is discharged out of the discharge pipe 102 to the outside of the scroll compressor 30 as high-pressure refrigerant.

In Embodiment 6, since any of the scroll compressors 30 as described above is provided, it is possible to reduce the decrease in the efficiency that is caused by high-to-low pressure leakage of refrigerant gas, and thus achieve a high-efficiency refrigeration cycle apparatus.

Embodiment 7

Embodiment 7 relates to a configuration obtained by connecting an injection circuit to the scroll compressor 30 according to any one of Embodiments 1 to 5 as described above.

Figure 27:
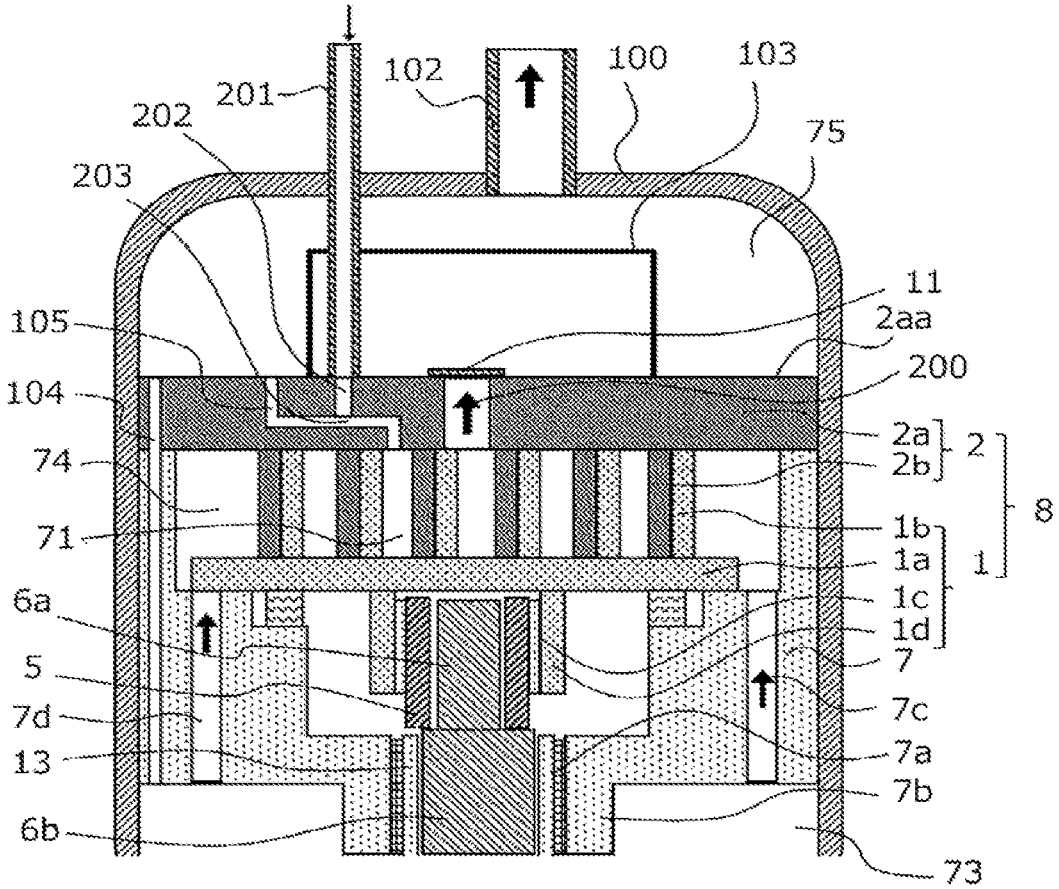
FIG. 27 is a schematic horizontal cross-sectional view illustrating an oil separating mechanism and the vicinity thereof in a scroll compressor according to Embodiment 7 of the present invention.
Figure 28:
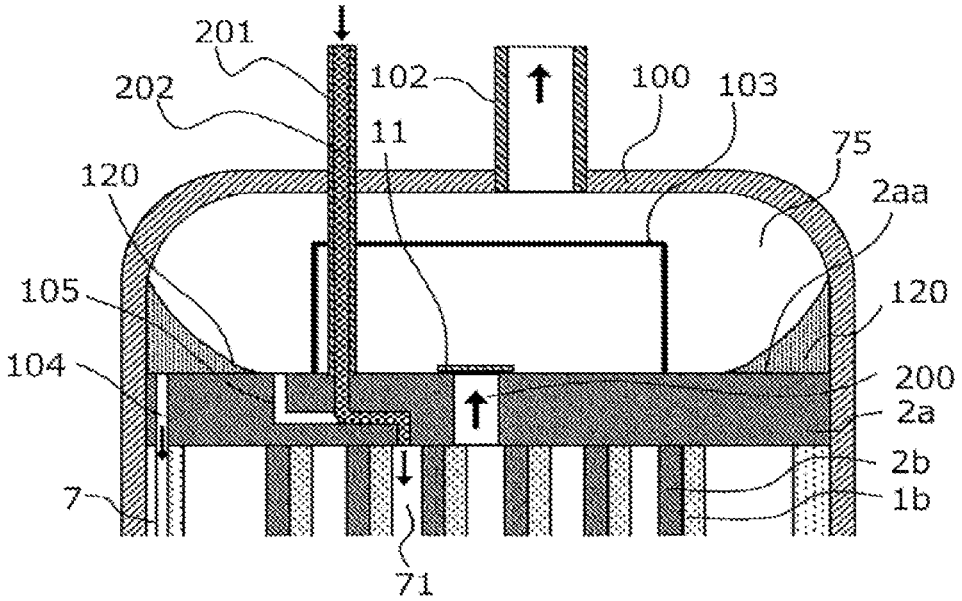
FIG. 28 is a schematic vertical cross-sectional view illustrating a flow of injection refrigerant in the scroll compressor according to Embodiment 7 of the present invention.

FIG. 27 is a schematic horizontal cross-sectional view illustrating an oil separating mechanism and the vicinity thereof in a scroll compressor according to Embodiment 7 of the present invention. FIG. 28 is a schematic vertical cross-sectional view illustrating a flow of injection refrigerant in the scroll compressor according to Embodiment 7 of the present invention.

The scroll compressor 30 according to Embodiment 7 has a configuration in which an injection pipe 201 externally inserted into the sealed container 100 is connected to the fixed base plate 2*a*, and this connection portion between the injection pipe 201 and the fixed base plate 2*a* is made to communicate with the second flow passage 105 by a communication flow passage 202 formed in the fixed base plate 2*a*.

In this configuration, injection refrigerant is injected from the injection pipe 201 into the compression mechanism 8 through the communication flow passage 202 and part of the second flow passage 105. In other words, a flow passage that makes the discharge space 75 communicate with the inside of the compression mechanism 8 is filled with the injection refrigerant, as a result of which the discharge space 75 and the inside of the compression mechanism 8 become unable to communicate with each other.

Therefore, in Embodiment 7, it is possible to obtain not only the above advantages of Embodiments 1 to 5, but the following advantage. That is, under operating conditions where the second flow passage 105 is not filled with the refrigerating machine oil 120 because, as described above, the flow velocity of refrigerant discharged from the blowoff portion 103*b* is high and the refrigerating machine oil collecting on the fixed base plate 2*a* is made to fly off, it is possible to reduce leakage of refrigerant from the discharge space 75 to the compression mechanism 8.

Embodiment 8

Embodiment 8 relates to a refrigeration cycle apparatus provided with the scroll compressor 30 according to Embodiment 7. Embodiment 8 will be described by referring mainly to the differences between Embodiment 8 and the refrigeration cycle apparatus of Embodiment 6 which is provided as illustrated in FIG. 26.

Figure 29:
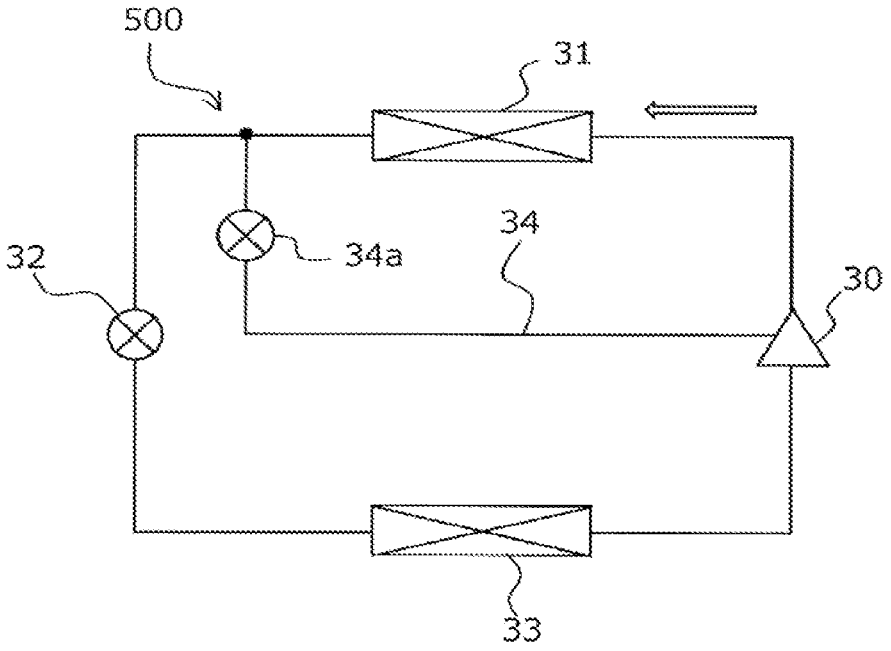
FIG. 29 is a diagram illustrating an example of a refrigeration cycle apparatus including an injection circuit provided with a scroll compressor according to Embodiment 8 of the present invention.

FIG. 29 illustrates an example of a refrigeration cycle apparatus according to Embodiment 8 of the present invention, which includes an injection circuit provided with the scroll compressor.

A refrigeration cycle apparatus 500 as illustrated in FIG. 29 is obtained by adding the following components to the main circuit of Embodiment 6 as illustrated in FIG. 26. To be more specific, the refrigeration cycle apparatus 500 includes an injection circuit 34 that branches off from an area between the condenser 31 and the expansion valve 32 and is connected to the injection pipe 201 of the scroll compressor 30. The injection circuit 34 includes an expansion valve 34*a* serving as a flow control valve, which can adjust the flow rate of injection refrigerant that is injected into the scroll compressor 30.

In the refrigeration cycle apparatus 500 having the above configuration, the main circuit is operated in the same manner as that of Embodiment 6. In the refrigeration cycle apparatus 500 of Embodiment 8, injection refrigerant, which is part of the main refrigerant discharged from the scroll compressor 30 and has passed through the condenser 31, flows into the injection circuit 34. After flowing into the injection circuit 34, the refrigerant is reduced in pressure by the expansion valve 34*a* and made to be in a liquid state or two-phase state, and flows into the injection pipe 201 of the scroll compressor 30. After flowing into the injection pipe 201, the injection refrigerant being in the liquid state or two-phase state passes through the communication flow passage 202 and part of the second flow passage 105, and flows into the compression mechanism 8.

In Embodiment 8, the same advantages as or similar advantages to those of Embodiment 6 are obtained, and in addition the communication flow passage 202 and part of the second flow passage 105 are closed by the injection refrigerant. It is therefore possible to reduce leakage of refrigerant from the discharge space 75 to the compression mechanism 8 through the second flow passage 105 during the high-speed operation.

Although Embodiments 1 to 8 are described above as separate embodiments, characteristic configurations of the embodiments may be appropriately combined to form a scroll compressor. For example, Embodiment 2 may be combined with Embodiment 4 such that the swirling-flow assist guides as illustrated in FIG. 18 are applied to the scroll compressor that includes the oil separating mechanism 103 as illustrated in FIG. 11.

| Reference Signs List | |
|---|---|
| 1 | orbiting scroll |
| 1a | orbiting base plate |
| 1b | orbiting spiral element |
| 1c | orbiting bearing |
| 1d | boss |
| 2 | fixed scroll |

-continued

| Reference Signs List | |
|---|---|
| 2a | fixed base plate |
| 2aa | back surface |
| 2b | fixed spiral element |
| 5 | slider |
| 6 | rotation shaft |
| 6a | eccentric shaft portion |
| 6b | main shaft portion |
| 6c | sub-shaft portion |
| 7 | frame |
| 7a | main bearing |
| 7b | boss |
| 7c | refrigerant inlet |
| 7d | refrigerant inlet |
| 8 | compression mechanism |
| 8a | spiral structure |
| 9 | sub-frame |
| 9a | sub-frame holder |
| 10 | sub-bearing |
| 11 | discharge valve |
| 13 | sleeve |
| 30 | scroll compressor |
| 31 | condenser |
| 32 | expansion valve |
| 33 | evaporator |
| 34 | injection circuit |
| 34a | expansion valve |
| 60 | first balance weight |
| 61 | second balance weight |
| 70 | suction chamber |
| 71 | compression chamber |
| 71a | compression chamber |
| 71a1 | compression chamber |
| 71a2 | compression chamber |
| 71b | compression chamber |
| 71b1 | compression chamber |
| 71b2 | compression chamber |
| 73 | suction space |
| 74 | spiral space |
| 75 | discharge space |
| 75a | oil separation space |
| 100 | sealed container |
| 100a | oil sump |
| 101 | suction pipe |
| 102 | discharge pipe |
| 103 | oil separating mechanism |
| 103a | guide container |
| 103b | blowoff portion |
| 104 | first flow passage |
| 104a | opening |
| 105 | second flow passage |
| 105a | opening |
| 105b | opening |
| 106 | swirling-flow assist guide |
| 110 | motor mechanism |
| 110a | motor stator |
| 110b | motor rotator |
| 111 | pump element |
| 113a | first wall portion |
| 113b | second wall portion |
| 113c | gap |
| 114a | first wall portion |
| 114b | second wall portion |
| 114c | gap |
| 115a | first wall portion |
| 115b | second wall portion |
| 115c | gap |
| 120 | refrigerating machine oil |
| 200 | discharge port |
| 201 | injection pipe |
| 202 | communication flow passage |
| 204a | base circle center |
| 204a-1 | base circle center |
| 204b | base circle center |
| 205a | inward surface |
| 205b | inward surface |
| 206a | outward surface |
| 206b | outward surface |

-continued

| Reference Signs List | |
|---|---|
| 208 | tangent |
| 209 | blowoff direction |
| 210 | blowoff collision point |
| 211 | non-blowoff region |
| 213 | non-blowoff region |
| 300 | refrigeration cycle apparatus |
| 500 | refrigeration cycle apparatus |

The invention claimed is:

1. A scroll compressor comprising:

a compression mechanism including a fixed scroll and an orbiting scroll, the fixed scroll including a fixed base plate having a discharge port and a fixed spiral element, the orbiting scroll including an orbiting base plate and an orbiting spiral element, the fixed spiral element and the orbiting spiral element being combined in an axial direction of the compression mechanism to define a suction chamber and a compression chamber, the compression mechanism being configured to suck a gaseous fluid containing oil from the suction chamber into the compression chamber, compress the sucked fluid, and discharge the compressed fluid from the discharge port;

a sealed container housing the compression mechanism, having a discharge space and a suction space both provided in the compression mechanism, and including an oil sump to store oil therein at a bottom of the suction space, the discharge space being located on a side of the fixed base plate that is opposite to the compression chamber, the suction space being provided to allow a fluid to be sucked from an outside into the suction space;

a frame configured to support the orbiting scroll on a side of the orbiting scroll that is opposite to the compression chamber; and an oil separating mechanism provided in the discharge space to cover the discharge port, including a guide container having a blowoff port, and configured to swirl a fluid blown into an oil separation space through the discharge port and the blowoff port to separate oil from the fluid, the oil separation space being provided in the discharge space and outward of the guide container, wherein the fixed base plate and the frame have a first flow passage that extends through the fixed base plate and the frame to supply the oil separated by the oil separating mechanism to the oil sump; and the fixed base plate has a second flow passage which extends through the fixed base plate to supply the oil separated by the oil separating mechanism into the compression mechanism.

2. The scroll compressor of claim 1, wherein in a case where the fixed base plate is divided into two regions with respect to a straight line that perpendicularly intersects an other straight line at a center of the fixed base plate as the fixed base plate is viewed in the axial direction, the other straight line passing through the center of the fixed base plate and a blowoff collision point at which an extension line from the blowoff port in a blowoff direction of the fluid intersects the sealed container, openings of the first flow passage and the second flow passage that adjoin the oil separation space are located in one of the regions that does not include the blowoff collision point.

3. The scroll compressor of claim 1, wherein in a case where an upper surface of the sealed container is divided into two regions with respect to a straight line that perpendicularly intersects an other straight line at a center of the fixed base plate as the fixed base plate is viewed in the axial direction, the other straight line passing through the center of the fixed base plate and a blowoff collision point at which an extension line from the blowoff port in a blowoff direction of the fluid intersects the sealed container, a discharge pipe is connected to one of the regions that does not have the blowoff collision point.

4. The scroll compressor of claim 1, wherein in the fixed base plate, an opening of the second flow passage that adjoins the oil separation space is formed inward of an opening of the first flow passage that adjoins the oil separation space, in a radial direction of the fixed base plate.

5. The scroll compressor of claim 1, wherein the guide container of the oil separating mechanism is formed by a first wall portion formed in a shape of an arched surface and a second wall portion formed in a planar shape or in a shape of an arched surface, the second wall portion being continuous with one of ends of the first wall portion in a circumferential direction thereof, and a gap serving as the blowoff port is formed between the other end of the first wall portion in the circumferential direction and the second wall portion.

6. The scroll compressor of claim 1, further comprising a swirling-flow assist guide provided on an opposite side of a side of a flow passage, from which the fluid blown out from the blowoff port of the guide container flows in a swirl direction of the fluid, the flow passage being a flow passage along with the fluid blown out from the blowoff port until the fluid collides with an inner surface of the sealed container, the swirling-flow assist guide being configured to assist flowing of the fluid blown out of the blowoff port such that the fluid flows in the swirl direction.

7. The scroll compressor of claim 1, further comprising a plurality of protruding swirling-flow assist guides provided on an outer peripheral portion of a surface of the fixed base plate that is opposite to the compression chamber, and arranged at intervals in a circumferential direction of the fixed base plate, wherein a height of each of the swirling-flow assist guides from the fixed base plate in the axial direction is constant, and the swirling-flow assist guides each have an inclined surface that is inclined inwardly from one of ends thereof to the other in a swirl direction of the fluid as viewed in the axial direction.

8. The scroll compressor of claim 1, further comprising a plurality of protruding swirling-flow assist guides provided on an outer peripheral portion of a surface of the fixed base plate that is opposite to the compression chamber and arranged at intervals in a circumferential direction of the fixed base plate, wherein a height of each of the swirling-flow assist guides from the fixed base plate in the axial direction increases from one of ends of each swirling-flow assist guide to the other in a swirl direction of the fluid, and the swirling-flow assist guides each have a constant thickness in the radial direction.

9. The scroll compressor of claim 1, further comprising an injection pipe externally extending through the sealed container and connected to the fixed base plate, wherein a communication flow passage is formed in the fixed base plate to allow a connection portion between the injection pipe and the fixed base plate to communicate with the second flow passage.

10. A refrigeration cycle apparatus comprising the scroll compressor of claim 1, a condenser, a pressure-reducing device comprising an expansion valve, and an evaporator.

11. The refrigeration cycle apparatus of claim 10, further comprising:

an injection circuit branching off from an area between the condenser and the pressure-reducing device and connected to the scroll compressor; and a flow control valve configured to adjust a flow rate in the injection circuit.

12. The scroll compressor of claim 1, wherein the second flow passage has a flow passage that extends from an outer periphery of the fixed base plate, which is outside the guide container, to a center side, where the discharge port is located.

* * * * *